US005433516A

United States Patent [19]

Beals et al.

[11] Patent Number: 5,433,516

[45] Date of Patent: Jul. 18, 1995

[54] FILING CABINETS

[75] Inventors: Ralph Beals; Stanley M. Howe; William G. Kackley, all of Muscatine, Iowa

[73] Assignee: Hon Industries, Inc., Muscatine, Iowa

[21] Appl. No.: 997,213

[22] Filed: Dec. 28, 1992

Related U.S. Application Data

[60] Continuation-in-part of Ser. No. 860,561, Mar. 30, 1992, Pat. No. 5,214,836, and Ser. No. 654,351, Feb. 12, 1992, Pat. No. 5,251,974, which is a continuation-in-part of Ser. No. 279,330, Dec. 2, 1988, Pat. No. 5,102,210, which is a continuation of Ser. No. 30,052, Mar. 24, 1987, abandoned, said Ser. No. 860,561, is a continuation of Ser. No. 518,129, May 3, 1990, abandoned, which is a division of Ser. No. 279,330, May 3, 1990.

[51] Int. Cl.[6] ..... A47B 47/02

[52] U.S. Cl. ..... 312/257.1; 312/263

[58] Field of Search ..... 312/257.1, 263, 265.5

[56] References Cited

U.S. PATENT DOCUMENTS

| | | | |
|---|---|---|---|
| 1,055,697 | 3/1913 | Beecher . | |
| 1,200,882 | 10/1916 | Schaefer . | |
| 1,238,215 | 8/1917 | Terrell . | |
| 1,282,833 | 10/1918 | Holder . | |
| 1,292,946 | 1/1919 | Yawman . | |
| 1,321,097 | 11/1919 | Gonzalez . | |
| 1,340,562 | 5/1920 | Sandmann . | |
| 1,450,180 | 4/1923 | Jamison . | |
| 1,523,653 | 1/1925 | Larson et al. . | |
| 1,560,922 | 11/1925 | Wege | 312/265.5 |
| 1,757,227 | 5/1930 | Wheary . | |
| 1,975,613 | 10/1934 | Nystrom et al. | 312/265.5 X |
| 2,027,154 | 1/1936 | Derman . | |
| 2,069,953 | 1/1939 | Miller et al. | 312/265.5 X |
| 2,155,128 | 4/1939 | Gray . | |
| 2,331,529 | 10/1943 | Wolters et al. . | |
| 2,437,665 | 3/1948 | Rose . | |
| 2,488,916 | 11/1949 | Johnson . | |

(List continued on next page.)

FOREIGN PATENT DOCUMENTS

| | | | |
|---|---|---|---|
| 0340319A1 | 5/1988 | European Pat. Off. . | |
| 1447386 | 6/1965 | France . | |
| 2386965 | 12/1978 | France | 312/263 |
| 533367 | 8/1931 | Germany | 312/263 |
| 1817482 | 8/1969 | Germany . | |
| 2153178 | 5/1973 | Germany . | |
| 2607171 | 9/1977 | Germany . | |
| 2808061 | 9/1978 | Germany . | |
| 360961 | 11/1931 | United Kingdom . | |

OTHER PUBLICATIONS

Hon Industries Inc. Fourth Quarter 1987 Annual Report.

*Primary Examiner*—Peter R. Brown

*Attorney, Agent, or Firm*—Jones, Day, Reavis & Pogue

[57] ABSTRACT

A storage cabinet is formed of a plurality of generally planar prepainted sheet metal panels adhesively laminated to one another substantially throughout overlapping edge portions to define a case of said cabinet. Certain of the panels are formed with deep narrow inwardly projecting reinforcing ribs disposed along edge portions of one side of the cabinet near the vertical corners, thereby forming reinforcing structures adjacent those corners. These ribs are narrow channels open to the outside of the cabinet. Another side panel formed with edge flanges at right angles to its major plane is mounted with these flanges disposed in the open channels, thereby further enhancing the strength of the cabinet, facilitating construction, and hiding the edges of the latter panel. Improved roller slide supports for the drawers are included, in which channels are formed for lateral confinement of the support rollers to desired predetermined tracks. In preferred embodiments the drawer track and its related guide components are integrated into the drawers. The drawers also include drawer boxes of thin sheet metal with mating molded plastic subfronts. The subfronts provide structural strength for the front end of the drawers and also include configurations to provide for ease of assembly of the drawers and related components, such as latching and locking elements.

15 Claims, 21 Drawing Sheets

U.S. PATENT DOCUMENTS 2,520,506 8/1950 Mankki .
2,547,463 4/1951 Haut .
2,570,958 10/1951 Lee .
2,620,251 12/1952 Restivo .
2,727,800 12/1955 Snider .
2,780,510 2/1957 Cole, Jr. .
2,826,474 3/1958 Haydu .
2,864,656 12/1958 Yorinks .
2,868,608 1/1959 Gunn et al. .
2,880,040 3/1959 Gomersall .
2,981,584 4/1961 Friend .
3,278,250 11/1966 Vogt .
3,328,102 6/1967 Stackhouse .
3,328,106 6/1967 Mullin .
3,346,316 10/1967 Morioka et al. .
3,386,784 6/1968 Oppenhuizen et al. .
3,389,949 6/1968 Studinski et al. .
3,399,941 9/1968 Hansen et al. .
3,404,931 10/1968 Fall et al. .
3,437,392 4/1968 Hilfinger .
3,494,685 2/1970 Fiterman et al. .
3,497,279 2/1970 Chovanec .
3,542,447 11/1970 Himelreich .
3,554,627 1/1971 Mock .
3,589,783 6/1971 Studinski et al. ..... 312/217
3,597,038 8/1971 Kunishima .
3,653,627 2/1971 Whipps .
3,664,716 5/1972 Johnson .
3,716,283 2/1973 Little .
3,738,726 6/1973 Burst et al. .
3,767,281 10/1973 Adams .
3,801,166 4/1974 York .
3,835,354 9/1974 Torres-Pena .
3,875,633 4/1975 Cornell .
3,900,236 8/1975 Goulish et al. .
3,909,090 9/1975 Breckner et al. .
3,969,008 7/1976 Pergler .
3,999,820 12/1976 Haag .
4,077,686 3/1978 Bukaitz ..... 312/265.5
4,102,554 7/1978 Reimer .
4,121,878 10/1978 Lokken .
4,138,175 2/1979 Tattershall .
4,145,100 3/1979 Klaus .
4,161,125 7/1979 Degnan .
4,181,383 1/1980 Naef .
4,196,948 4/1980 Gavel et al. .
4,232,920 11/1980 Bukaitz .
4,272,138 6/1981 Stark .
4,272,139 6/1981 Fler .
4,288,132 9/1981 Znamirowski et al. ..... 312/263
4,296,982 10/1981 Kullander ..... 312/265.5
4,296,983 10/1981 Rogers et al. ..... 312/263
4,298,236 11/1981 Laroche .
4,355,851 10/1982 Slusser .
4,429,930 2/1984 Blouin .
4,433,788 2/1984 Erlam et al. .
4,437,715 3/1984 Jenkins .
4,438,994 3/1984 Davis .
4,441,767 4/1984 Stark .
4,447,098 5/1984 Parker .
4,473,166 9/1984 Breiter .
4,480,883 11/1984 Young .
4,500,146 2/1985 Peterson .
4,541,675 9/1985 Everett .
4,561,706 12/1985 Grati .
4,586,348 5/1986 Nakayama et al. .
4,595,247 6/1986 Zank .
4,601,522 7/1986 Röck .
4,671,580 6/1987 Shiou .
4,671,581 6/1987 Faust et al. .
4,717,215 1/1988 Everts .
4,762,379 8/1988 Beam et al. ..... 312/320
4,788,395 11/1988 Sakoda .
4,817,861 4/1989 Henrikson .
5,102,210 4/1992 Beals .
5,161,870 11/1992 Mason et al. ..... 312/348.4
5,211,461 5/1993 Teufel et al. ..... 312/334.4

FIG. 30
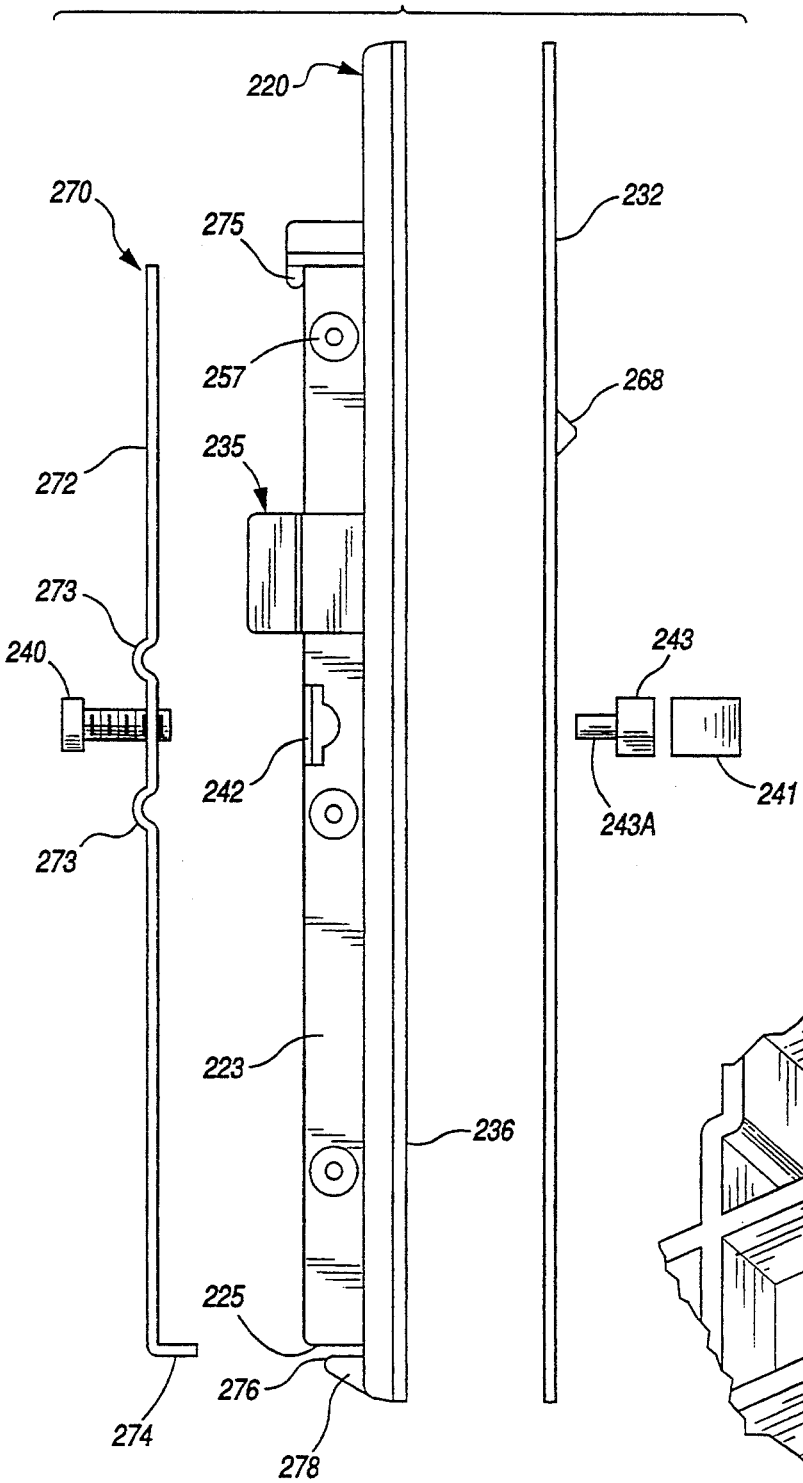
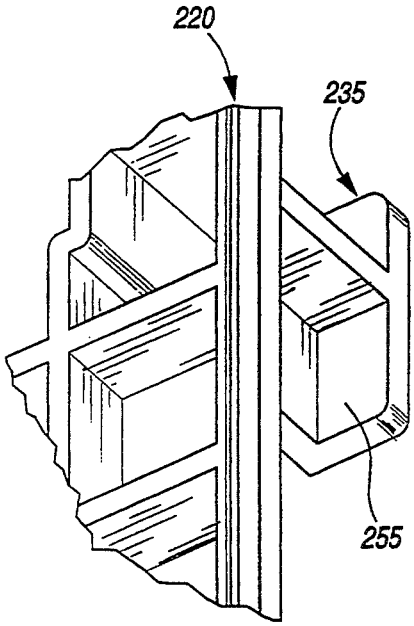
FIG. 31

FILING CABINETS

This application is a continuation-in-part of application Ser. No. 07/860,561, filed Mar. 30, 1992, (now U.S. Pat. No. 5,214,836), which is a continuation of prior application Ser. No. 07/518,129, filed May 3, 1990, (now abandoned), as a division of prior application Ser. No. 07/279,330, filed Dec. 2, 1988, (now U.S. Pat. No. 5,102,210), and also is a continuation-in-part of application Ser. No. 07/654,351, filed Feb. 12, 1992, (now U.S. Pat. No. 5,251,974), as a continuation-in-part of said application Ser. No. 07/279,330, (now U.S. Pat. No. 5,102,210). Said application Ser. No. 07/279,330, was a continuation of application Ser. No. 07/030,052, filed Mar. 24, 1987, (now abandoned). The disclosures of each of the foregoing applications and U.S. Pat. No. 5,102,210, also are incorporated herein by this reference.

BACKGROUND OF THE INVENTION

FIELD OF THE INVENTION

This invention relates to metal storage cabinets, such as filing cabinets, and to methods for constructing such cabinets. More particularly, this invention relates to forming very low-cost cabinets of rugged, sturdy construction from light gauge sheet steel. This invention further relates to interrelated constructions for suspending drawers in such cabinets, e.g., to provide filing cabinets, and to the construction of the drawers.

The cabinet case of this invention in particular is formed by appropriately shaping thin sheet steel components and assembling them by adhesively bonding those component parts to one another by adhesive bonding throughout overlapping areas of the assembled components to form a cabinet case generally as in the cabinets of the aforementioned applications and patent. Such cabinets currently are being manufactured and marketed by XLM Company of Mt. Pleasant, Iowa. This invention relates to improvements in such cabinets which maintain and improve their strength and ruggedness and enhance their appearance when formed from prefinished sheet material without post-assembly painting. This invention further relates to improvements in the slide mounting of drawers in such cabinets as well as in the construction of the drawers.

SUMMARY OF THE INVENTION

A storage cabinet is formed of a plurality of generally planar sheet metal panels adhesively laminated to one another substantially throughout overlapping edge portions to define a case of said cabinet. Certain of the panels are formed with deep narrow inwardly projecting reinforcing ribs disposed along edge portions of one side of the cabinet near the vertical corners, thereby forming reinforcing structures adjacent those corners. These ribs are narrow channels open to the outside of the cabinet. Another side panel formed with edge flanges at right angles to its major plane is mounted with these flanges disposed in the open channels, thereby further enhancing the strength of the cabinet and facilitating construction. This construction also hides the edges of the latter panel, which improves the appearance of the cabinet, particularly when fabricated of prefinished panels that have unfinished cut edges.

Further stiffener components also formed of the sheet metal are laminated in various corners of the cabinet. These include vertical front corner reinforcing channels of configurations for locating and affixing various other components such as slide supports and an improved lock bar mounting arrangement for drawers.

Improved roller slide supports for the drawers are included, in which channels are formed for lateral confinement of the support rollers to desired predetermined tracks. In preferred embodiments the drawer track and its related guide components are integrated into the drawers.

Drawers of improved designs include drawer boxes of thin sheet metal with mating molded plastic subfronts. The subfronts provide structural strength for the front end of the drawers and also include configurations to provide for ease of assembly of the drawers and related components, such as latching and locking elements.

OBJECTS OF THE INVENTION

It is an object of this invention to provide improved file cabinets formed of thin sheet metal.

It is a further object of this invention to provide such cabinets of improved strength and ruggedness.

It is another object of this invention to provide such cabinets which can be economically fabricated of a minimum number of component parts.

It is another object of this invention to provide cabinets of improved appearance when formed from prefinished sheet metal without post-assembly painting.

Another object of this invention is to provide improved roller slide supports for drawers in such cabinets, as well as improved slide supports.

Another object of this invention is to provide an improved and flexible design for drawers for storage cabinets and particularly for file cabinets.

It is another objection of this invention to provide an improved locking arrangement in such cabinets.

Other objects and advantages of this invention will become apparent, particularly to those skilled in the art, upon considering the following description and claims and upon reference to the accompanying drawings.

DESCRIPTION OF THE DRAWINGS

For a more complete understanding of this invention, reference may be made to the illustrative embodiments shown in the accompanying drawings and described further below by way of examples of the invention. In the drawings:

FIG. 30 is an exploded side view of the subfront assembly of the drawer in FIG. 27.

FIG. 31 is an enlarged partial perspective view of the lock boss portion of the molded subfront.

DETAILED DESCRIPTION OF ILLUSTRATED EMBODIMENTS OF THE INVENTION

The relationship and use of the various features of this invention will be better understood by the following detailed description. However, the embodiments of the invention described below are by way of examples only and applicants do not limit themselves to these embodiments. Furthermore, one should understand that the drawings are not necessarily to scale and that the embodiments are illustrated in part by graphic symbols and fragmentary views. In certain instances, details may have been omitted which are not necessary for an understanding of the present invention.

Figure 1:
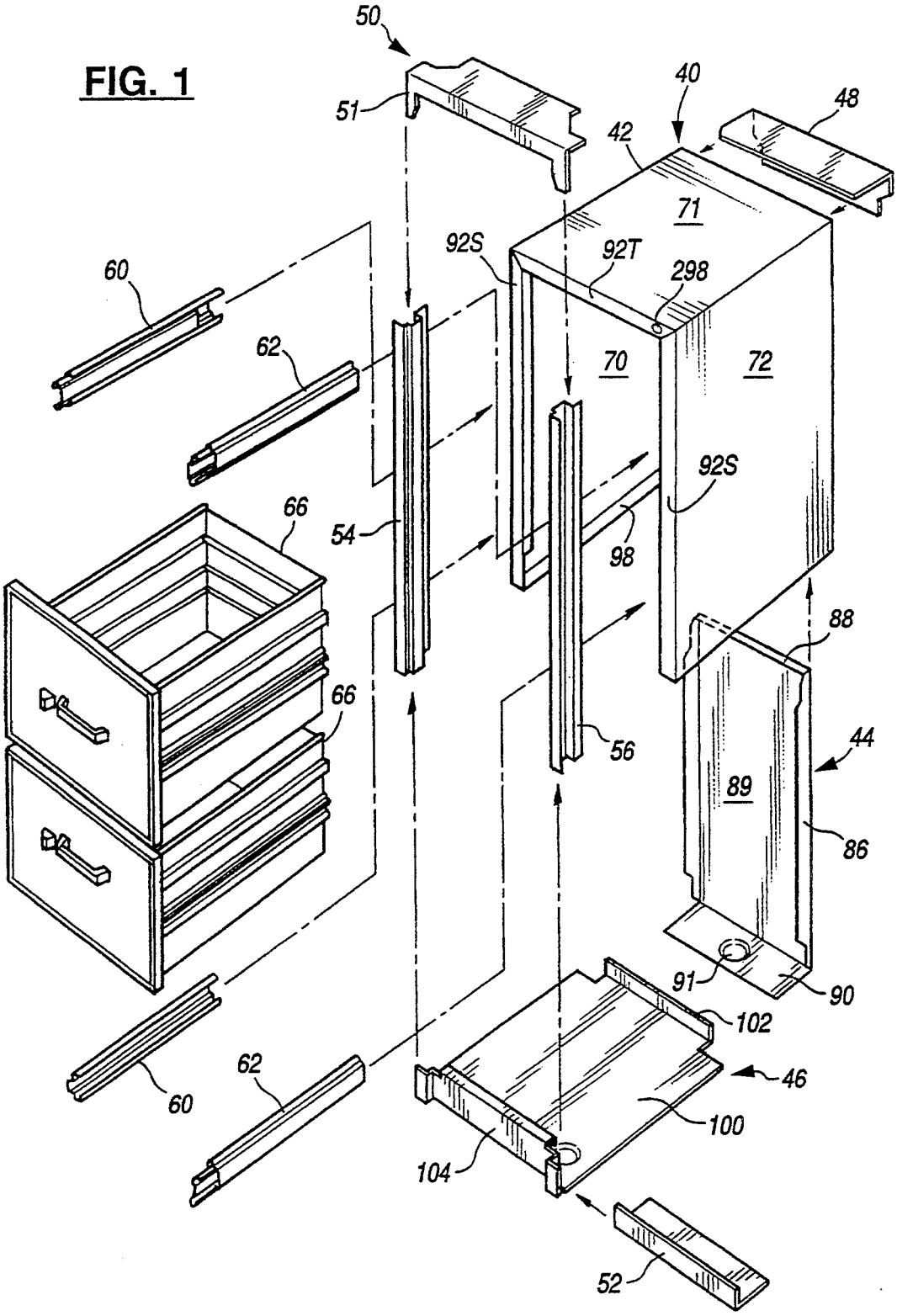
FIG. 1 is an exploded front perspective view of a two drawer storage cabinet and components to form a two drawer filing cabinet therefrom, employing teachings of this invention.

FIG. 1 illustrates the components of a filing cabinet 40 which comprises a preferred embodiment of this invention. Those components include a case wrapper 42, a case back 44, a base pan 46, a top back stiffener 48, a top front stiffener 50, and a bottom front stiffener 52, which collectively form a basic storage case. A pair of right-hand and left-hand vertical channels 54, 56 are designed to reinforce the side-front edges of the front opening of this storage cabinet. In addition, two sets of right and left drawer supports 60, 62 are included, along with two drawers 66, for assembly and use of this cabinet as a two-drawer file cabinet. The cabinet components are designed to be formed of thin sheet metal and assembled into edge overlapping relationship with one another and to be adhesively secured together by adhesive lamination substantially throughout the areas of overlap, and also to form reinforcing structures in appropriate critical areas, primarily at various corners of the assembly, to provide a strong, rugged cabinet construction fabricated with very thin sheet metal stock. One of the further features of this invention is that the edges of the various components, and particularly those of the external panel sections, are hidden in the final assembly. The adhesive construction facilitates the manufacture of such cabinets from pre-finished materials, thereby avoiding any necessity for post-assembly painting or other finishing. In this regard, the cabinet 40 employs features disclosed in the aforementioned prior patent applications. The construction by which the edges of the panel are hidden within the structure complements this result since the edges of some or all of the panel components may be unfinished as a result of the manner of cutting and forming the blanks which form these various components.

In general, the components illustrated in FIG. 1 are assembled with the unitary case wrapper 42 forming the two vertical sides and top of the cabinet, the case back 44 forming the rear or back side, and the base pan 46 closing the bottom and providing a front kick plate as well as providing gauging functions for positioning the lower edges of the case wrapper. The vertical channels are nested within the inner front vertical edges of the case wrapper, fitting behind the inturned flanges which define the front opening. These components are laminated together in the areas of overlap. This provides a cabinet construction of a minimum number of parts and which is of a rugged strong design, and which further is adapted to readily serve as a filing cabinet, as described in greater detail below.

The respective stiffeners 48, 50 and 52 preferably are added by adhesive lamination in the respective corners.

The drawer supports 60, 62 are separately inserted in appropriate interfitting relationship and mechanically attached, and the drawers are slidedly supported on those supports, in a generally conventional manner but preferably using the improved drawer roller slides as described hereinbelow. Also, a drawer locking bar 280 is slidably engaged and firmly supported on one of the vertical channels for selectively locking the drawers in their closed positions, preferably without use of separate fasteners, as described further below.

Figure 2:
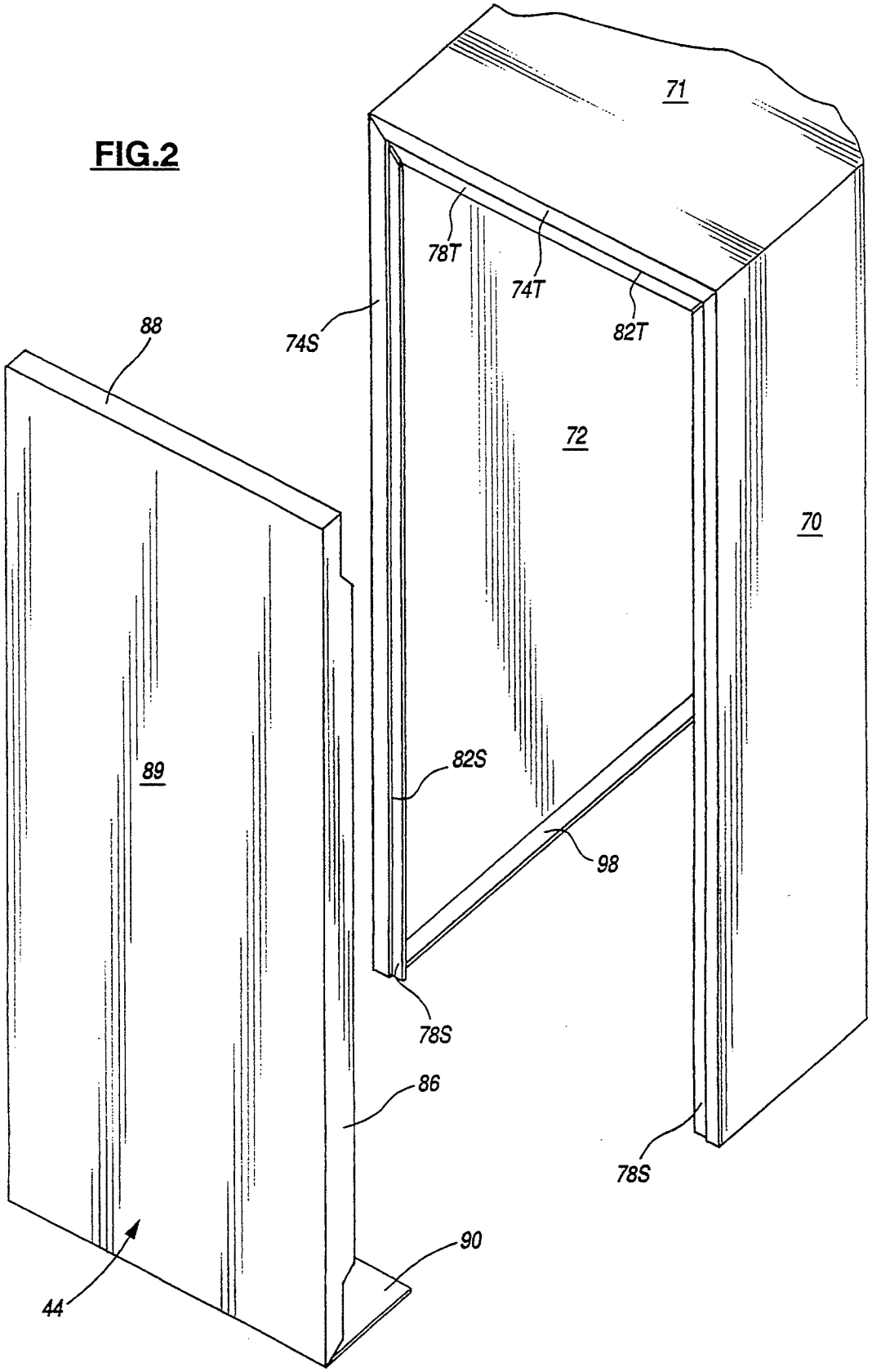
FIG. 2 is an exploded rear perspective view of the case wrapper and case back of the cabinet of FIG. 1.

Features embodied in this invention include providing the rear edges of the case wrapper with narrow deep ribs, and the related manner of joining the back panel 44 to the case wrapper 40. The ribs provide reinforcement along the rear edges of the cabinet case and also receive the edges of the case back. FIG. 2 illustrates this reinforcing rib and engagement flange relationship, with further details being apparent from FIGS. 5B, 6A and 9. Specifically, the rear edge portions of each of the side and top panels 70, 71 and 72 of the case wrapper are formed with an integral rear edge flange which includes a first portion 74, a rib 76 and a distal portion 78. (In FIGS. 5B, 6A and 9 the components 74, 76 and 78 are identified with subscripts S and T, according to whether the rib is on a side panel or a top panel, respectively.) The first portion 74 extends inwardly of the opening from the rear edge of the respective panel 70, 71, 72. A deep narrow U-shaped channel (reverse-bent) rib 76 extends inwardly of the case from the distal edge of the respective flange portion 74, thereby completing a C-shaped corner channel structure formed by the rib 76, flange 74 and the adjacent portion of the respective side panel 70, 72. The distal flange portion 78 extends from the remote edge of the respective rib 76 in a direction generally parallel to the plane of the portion 74. Each flange portion 78 preferably is offset inwardly of the cabinet, relative to flange portions 74, by approximately the thickness of the sheet material of the case back 44. The channel ribs 76 form shallow U-shaped reinforcement ribs, in planes generally parallel to the respective panels 70, 71 and 72, with their bights 80S, 80T disposed inwardly and their outer ends forming open slots 82S, 82T at the rear of the case wrapper 42.

Figure 5B:
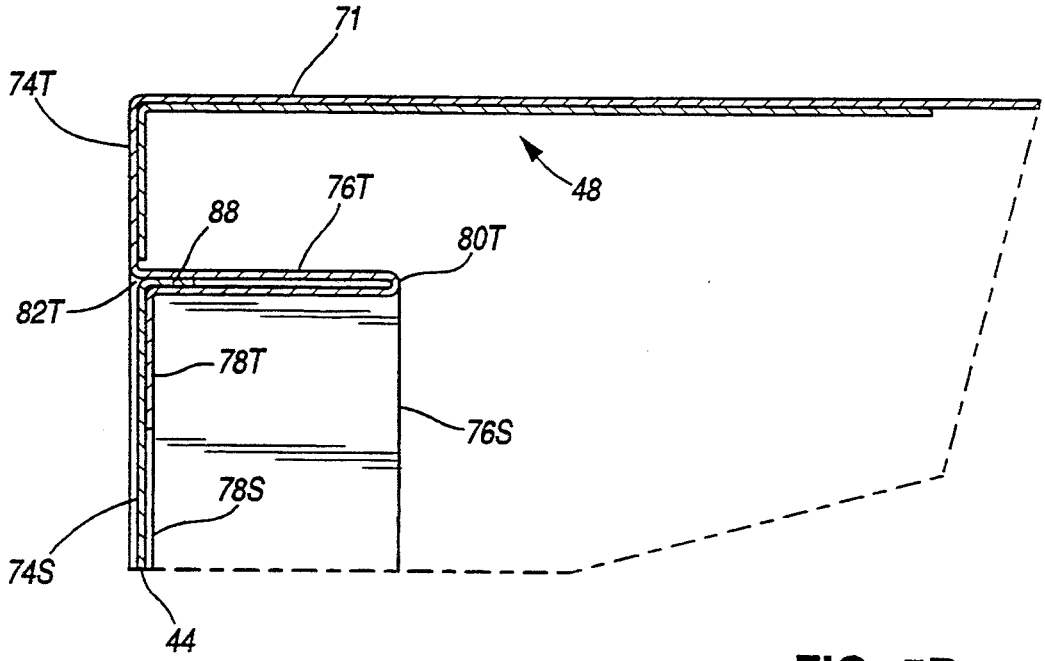
FIG. 5B is an enlarged view of the upper left corner portion of FIG. 5.
Figure 5C:
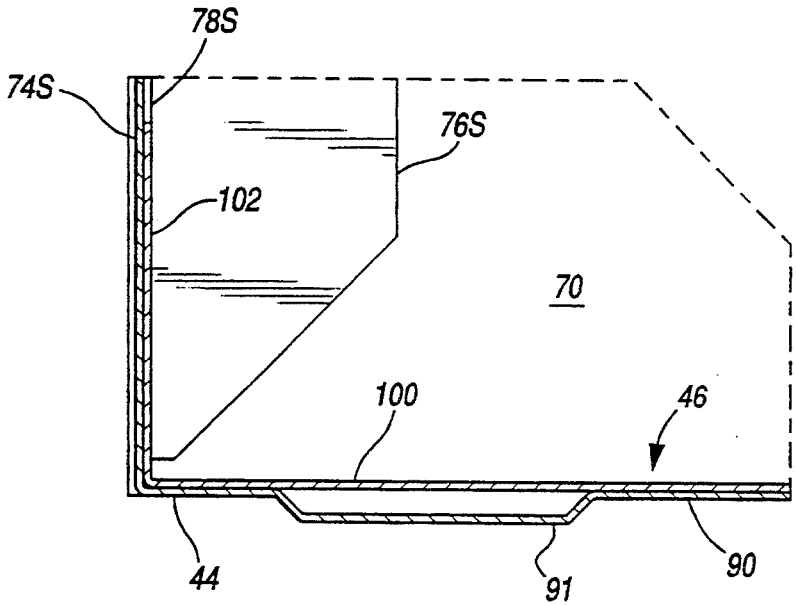
FIG. 5C is an enlarged view of the lower left corner portion of FIG. 5.
Figure 5D:
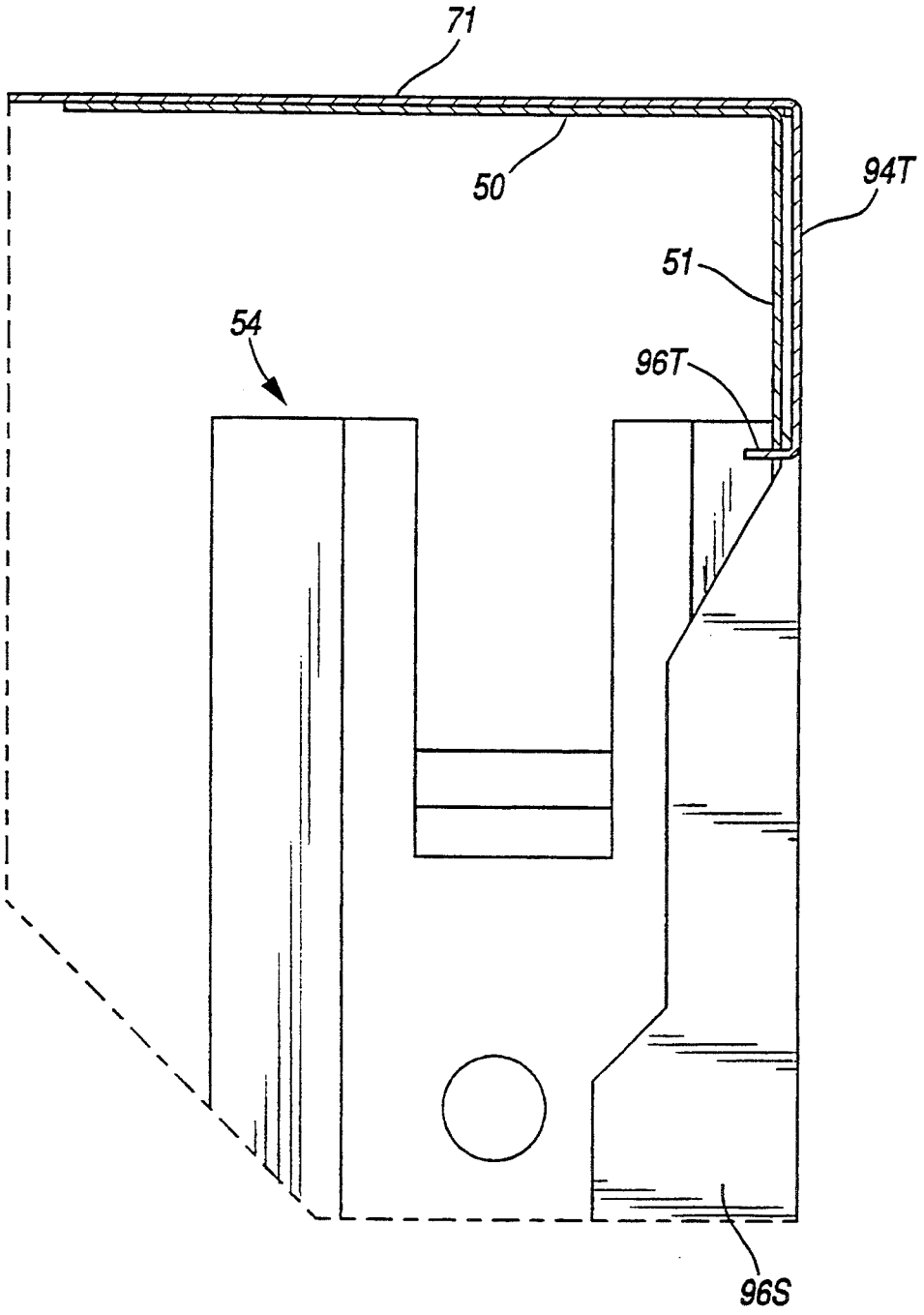
FIG. 5D is an enlarged view of the upper right corner portion of FIG. 5.
Figure 5E:
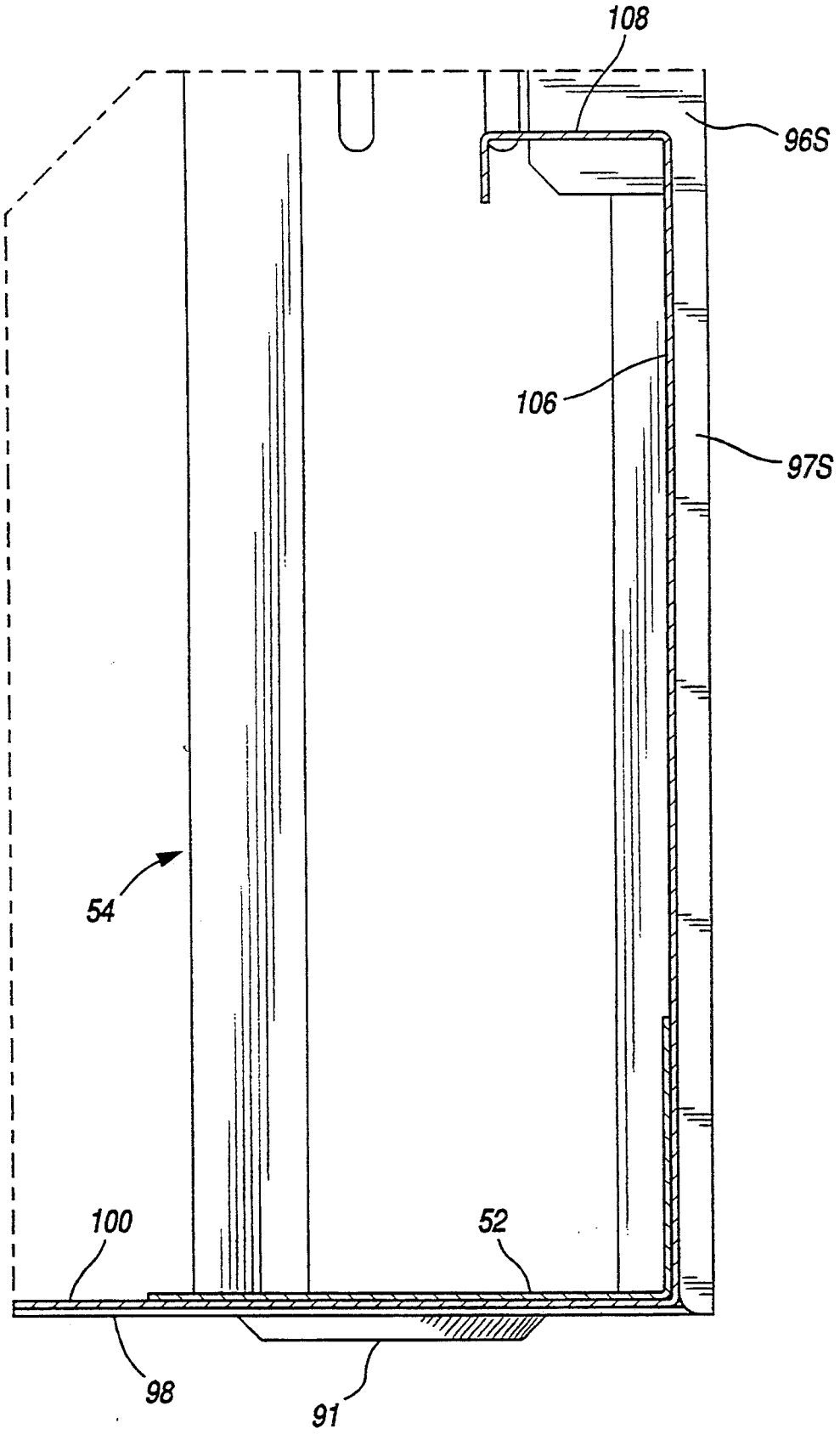
FIG. 5E is an enlarged view of the lower right corner portion of FIG. 5.
Figure 6A:
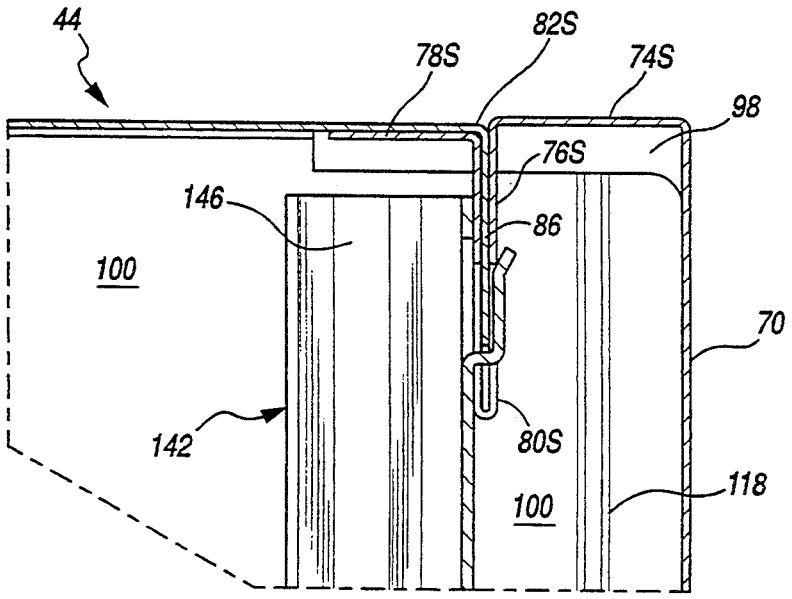
FIG. 6A is an enlarged view of the rear corner structure of the cabinet of FIG. 1, taken along line 6—6 of FIG. 4 and looking downward.
Figure 6B:
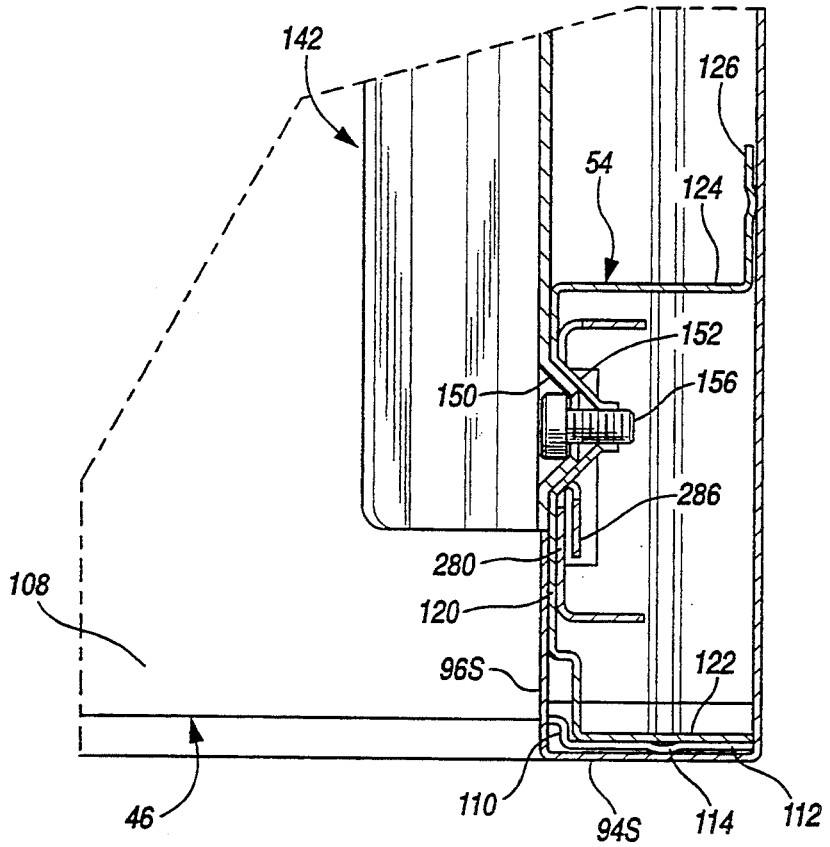
FIG. 6B is an enlarged view of the front corner structure of the cabinet of FIG. 1, taken along line 6—6 of FIG. 4 and looking downward.
Figure 7:
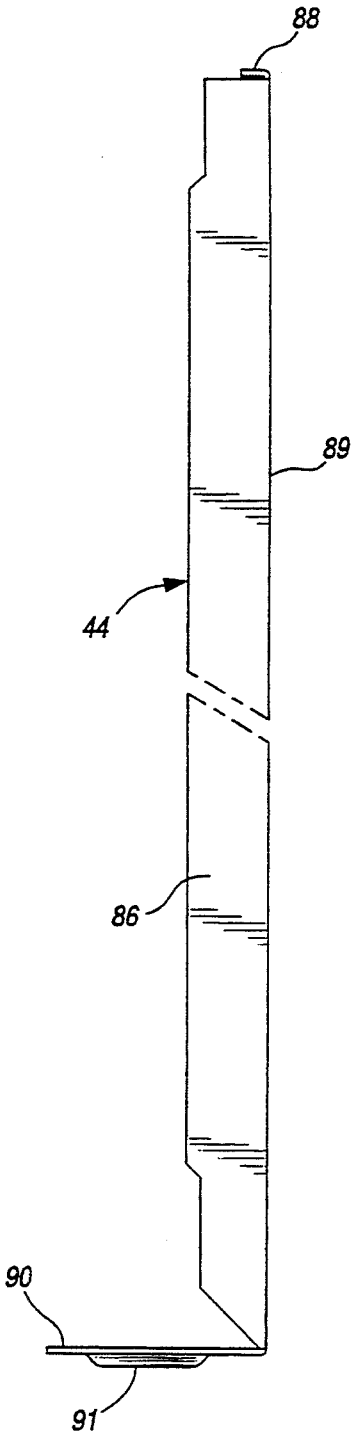
FIG. 7 is a side view of the case back of the cabinet of FIG. 1.
Figure 8:
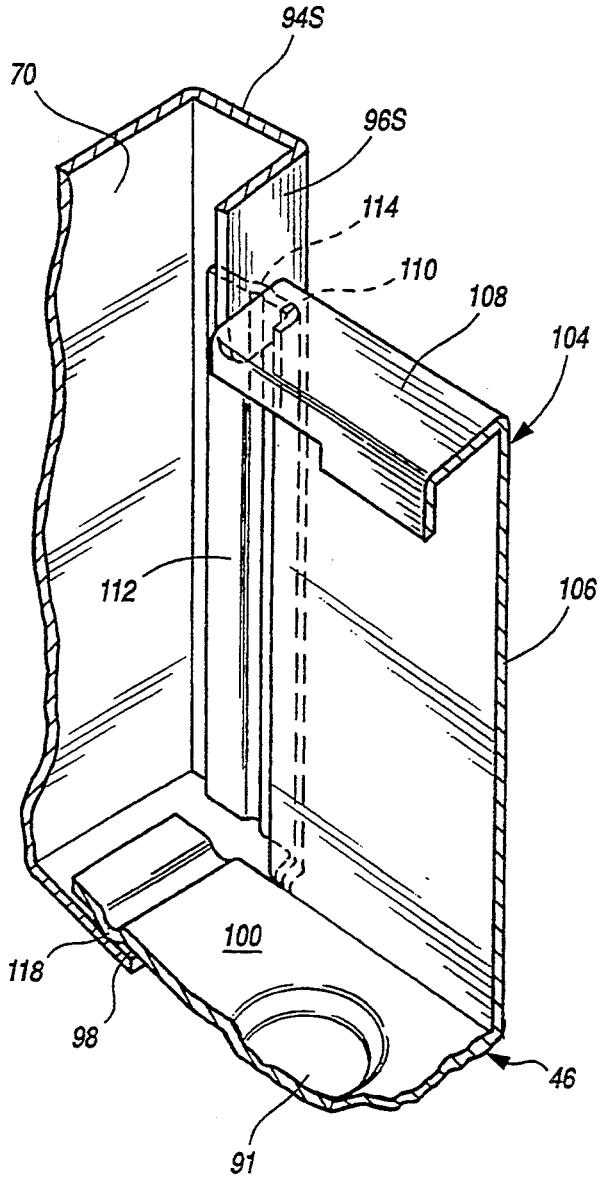
FIG. 8 is an enlarged partial perspective view of the lower right corner of the assembled case wrapper and base pan of FIG. 1, i.e., omitting the lower front stiffener and the right front vertical channel.

The case back 44 includes side flanges 86 and a top flange 88 each extending generally normal to the plane of the main panel portion 89, as well as a base flange 90 similarly disposed at its lower edge. Upon assembly of the casewrapper 42 and case back 44, the flanges 86 are received within the slots defined by the side ribs 76S, as seen in FIG. 6A, and the top flange 88 is received in the slot defined by the top rib 76T, as illustrated in FIG. 5B. Thereby the distal edges of the flanges 86, 88 are hidden within the respective ribs, and only prefinished panel corners appear at the inter-panel joints.

The distal flange portions 78S, 78T preferably are offset inward of the cabinet case by approximately the thickness of the material of the case back 44 relative to the plane of the flange portion 74S, 74T, whereby the assembled components provide a substantially planer back surface of the cabinet; see again FIGS. 5B and 6A. The case back is bonded to substantially the entire rearwardly exposed areas of the distal flange portions 78S, 78T by an adhesive, thus forming a dual thickness of material throughout these portions which combines with the triple thickness of material in the ribs, particularly the ribs 76S, to provide enhanced reinforcement of the resulting cabinet adjacent the rear vertical corners.

The flange 90 may be formed with an optional circular downward offset 91 as one base pad or "foot" on which the assembled cabinet may rest on a subjacent support surface, such as a floor.

The front edge portions of the case wrapper 42 are bent to form C-shaped channels 92S, 92T therealong, each having a face flange 94S, 94T and an inner-return flange 96S, 96T which extends in generally parallel-spaced relationship to the adjacent portion of the respective panel 70, 71, 72. Each of the flanges 92S is of reduced depth in the lower area 97S, which corresponds to the front kick plate as will be noted further below. A bottom end flange 98 extends inwardly at the bottom end of each of the panels 70, 72.

In the illustrated preferred embodiment, all of the portions and noted flanges of the case wrapper 42 are formed by cutting and bending a single unitary sheet metal blank.

Referring now to FIGS. 1, 5, 5E and 8, the base pan 46 includes a central base panel 100, a rear flange 102 which projects upwardly from the rear edge of the base panel 100, and a front panel portion 104 projecting upwardly from the front edge of the base panel 100. The rear corners of the base pan are notched such that the flange 102 fits between the two vertical flanges 78S and lies parallel to the case back panel to which it is adhesively laminated (see also FIG. 6A). The rear portion of the base panel 100 also overlies and is adhesively laminated to substantially the entire area of the case back flange 90. Thus, these overlapping laminated components form a rigid structure and reinforced lower rear corner of the cabinet.

The front flange portion 104 of the base pan includes a vertical kick plate panel section 106 and an L-shaped return section 108 which extends inwardly of the cabinet from the upper edge of panel 106. The upper portion of the panel section 106, as well as the return flange portion 108, extends between and abuts the lower portions of the flanges 96S and serves as a positioning gauge for the proper positioning of the lower front portions of the side walls of the cabinet. Shallow L-shaped wing flanges project from opposite edges of the kick plate portion 106, each being of a height corresponding generally to the length of the reduced flange sections 97S. Each of these wing flanges is of a shallow S-shape, including an offset section 110 and a planar securement portion 112 which overlies and is adhesively laminated to the inner surface of the respective case front flange 94S. In this regard, each of the wing flanges 112 preferably is formed with a shallow standoff rib 114 for gauging the thickness of the adhesive bond between its forward surface and the inner surface of the flange 94S. A similar shallow standoff rib 118 is formed along each side edge of the base panel 100 for similarly gauging the adhesive bond which is provided in laminating the side-edge portions of the panel 100 to the upper surfaces of the lower side flanges 98.

Two circular depressions may be formed in spaced relation to one another along the front portions of the panel 100 to form two front supports for the cabinet. Thus, three depressions 91 may provide three points of support for the cabinet on a subjacent floor or similar structure. However, these supports may be omitted.

Figure 5:
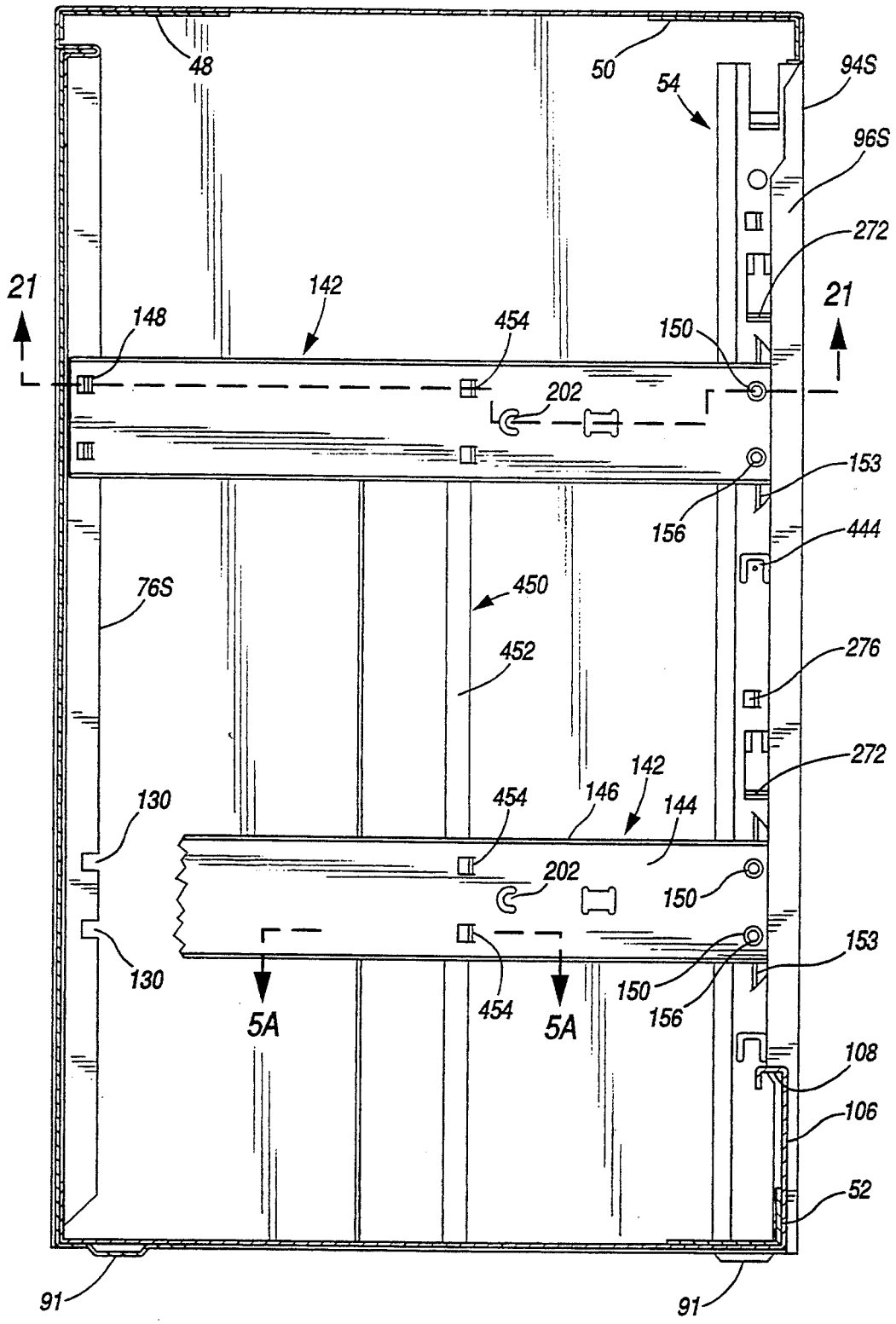
FIG. 5 is a sectional view taken along line 5—5 of FIG. 4, being an inside view of the right side of the cabinet of FIG. 1, with part of one of the case tracks broken away.

The bottom front stiffener 52 is of simple L-shaped configuration and is adhesively laminated substantially throughout its outer surfaces to the inner surface of the lower portion of kick plate section 106 and the upper forward portion of the base panel 100, across the area between the flanges 97S; see FIGS. 5 and 5LR.

The top back stiffener 48 extends across the width of the cabinet and is L-shaped, with the outer surface of the vertical flange bonded to the inner surface of the top flange 74T, and the horizontal flange bonded to the inner rear edge portion of the top panel 71, i.e., being laminated substantially throughout the areas of these flanges; see FIGS. 5 and 5B. This further reinforces the upper rear corner of the cabinet 40.

The top front stiffener 50 is similarly bonded to the undersurface of the front web portion of the top panel 71 and to the inner surface of flange 94T thereof. Narrow front edge portions 51 extend downward onto the upper portions of flanges 94S for further reinforcement of the top front structure and where they serve as bondline gauges between the upper ends of the channels 54, 56 and the inner surfaces of flange portions 94S; see FIGS. 1 and 5UR.

FIGS. 10–14 illustrate the vertical reinforcement and support channels 54 and 56. As will be seen, these channels are of identical cross-section, being mirror images of one another except that the right-hand channel 54 is formed with additional cut-out openings to accommodate the lock bar 280, as will be discussed further below. Each of the channels 54 and 56 is of general C-shaped cross-section comprising a front web portion 120 with side flanges 122 and 124 extending from each lateral edge, and a laterally extending attachment flange 126 extending outward from the distal edge of the side flange 124 generally parallel to the plane of the center section 120. The lateral flange 126 is formed with a stand-off rib 127 as a bondline gauge in the same manner as the aforementioned rib 114.

Each vertical channel 54, 56 extends substantially the full vertical height of the cabinet 40 and is nested within the respective front channel flanges 94S, 96S at the front of the cabinet 40. Flange 122 overlies the inner surface of the cabinet flange 94S and the base pan flange 112, and the flange 126 abuts a portion of the respective side panel 70, 72 adjacent the respective front corner. The front web 120 abuts the inner edge portion of the respective side flange 96S, as seen in FIG. 6F. Each of the channels 54, 56 includes a front offset portion 128 to accommodate fitting around the offset 110 of the base pan, as also seen in FIG. 6F. The top-front stiffener portion 51 and the basepan flanges 112 provide a bondline set-off of the front flange 122 from the adjacent surfaces to accommodate the desired thickness of adhesive for laminating this flange to the flange 94S as well as to flange 112 and the depending section 51 of the top-front stiffener.

The bondlines or clearances referred to herein preferable are on the order of 0.01 to 0.02 inches clearance between the respective overlapping surfaces to be adhesively laminated to one another. In all instances, preferred construction is that the adhesive lamination shall be continuous substantially throughout the respective overlapping surfaces.

The inner portion of each flange 96S which overlaps the outermost surface of the channel portion 120 may be adhesively bonded to the respective channel 54, 56. In the illustrated embodiment which is adapted for use as a multi-drawer filing cabinet, the vertical channels 54, 56 include several additional features for serving other functions. These include dimples 152 and tabs 153 for locating and supporting drawer supports, ramp tabs 250 as latch stops for drawers, L-shaped tabs 286 for slidably supporting a lock bar, openings 284 for passage of drawer lock tabs, and bendable tabs 444 for attachment of divider braces, all as will be referred to further below.

The cabinet 40 as thus far described provides a storage cabinet which is of strong and rugged construction even though formed of very thin sheet metal stock. In one example, all of the components of the cabinet 40 are of 24 gauge sheet steel stock, except the vertical channels 54, 56 which are of 20 gauge sheet steel. Moreover, in the preferred construction, such stock is prefinished, such as by being prepainted. The described construction avoids any penetrating or marring of the externally exposed surfaces of the blank stock during the forming and assembly operations, and further effects covering or "hiding" of essentially all of the edges of the blanks.

Figure 4:
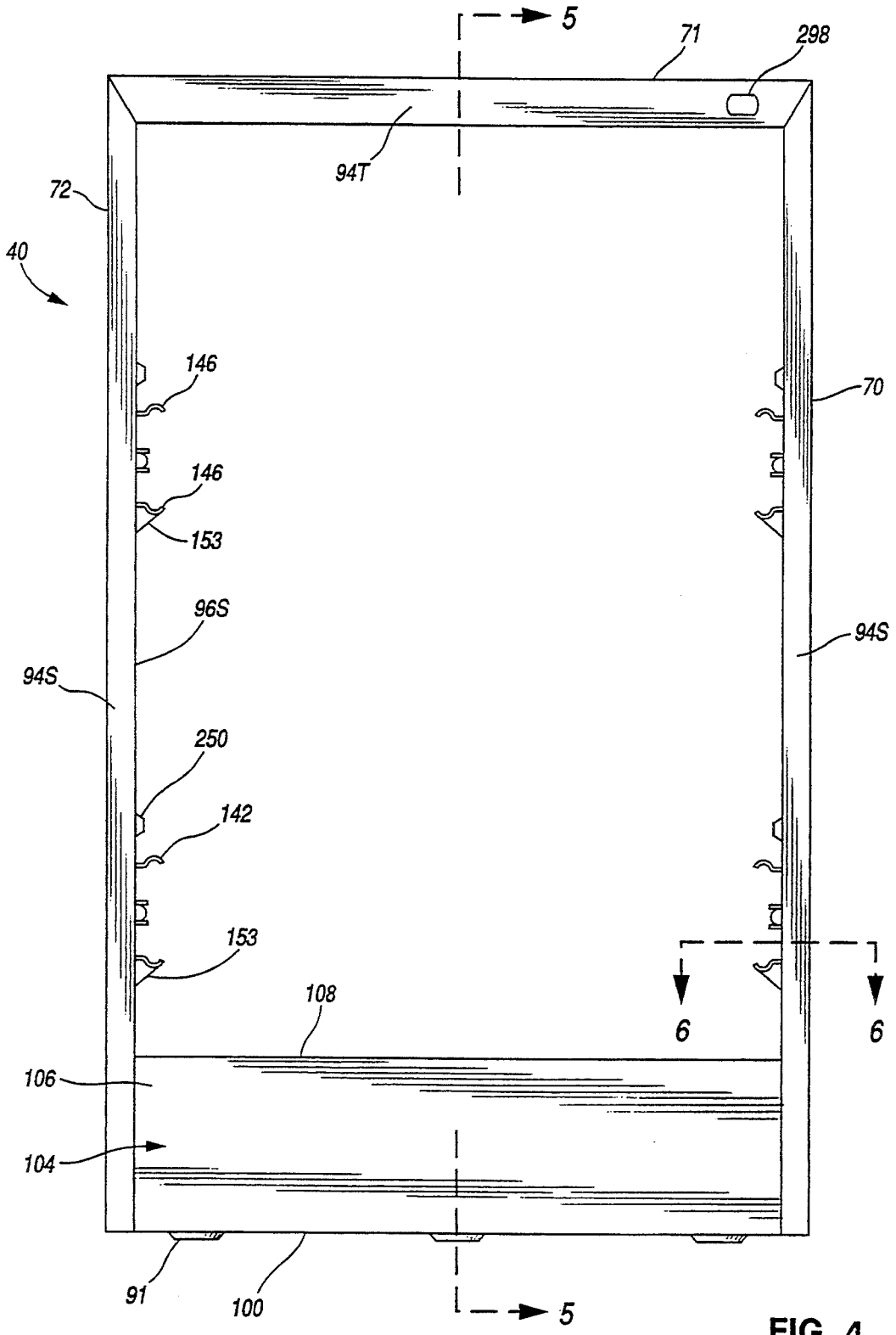
FIG. 4 is a front view of an assembled cabinet of FIG. 1, omitting the drawers and the movable drawer track components.

In the latter regard, it is also desirable to provide offset lips 99 extending at the upper ends of the respective flanges 94S to underlap the adjacent ends of the flange 94T in the final assembly. This assures apparent closure of the joint therebetween in the case wrapper, and also hides the upper end edges of the flanges 94S; see also FIG. 9A which shows an upper right corner in the process of being closed as the panels 71, 72 are bent from the coplanar positions of FIG. 9 to the cabinet case position of FIG. 4.

Figure 3A:
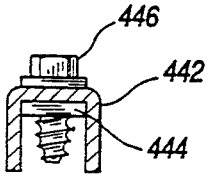
FIG. 3A is a sectional view taken along line 3A—3A of FIG. 3.
Figure 3:
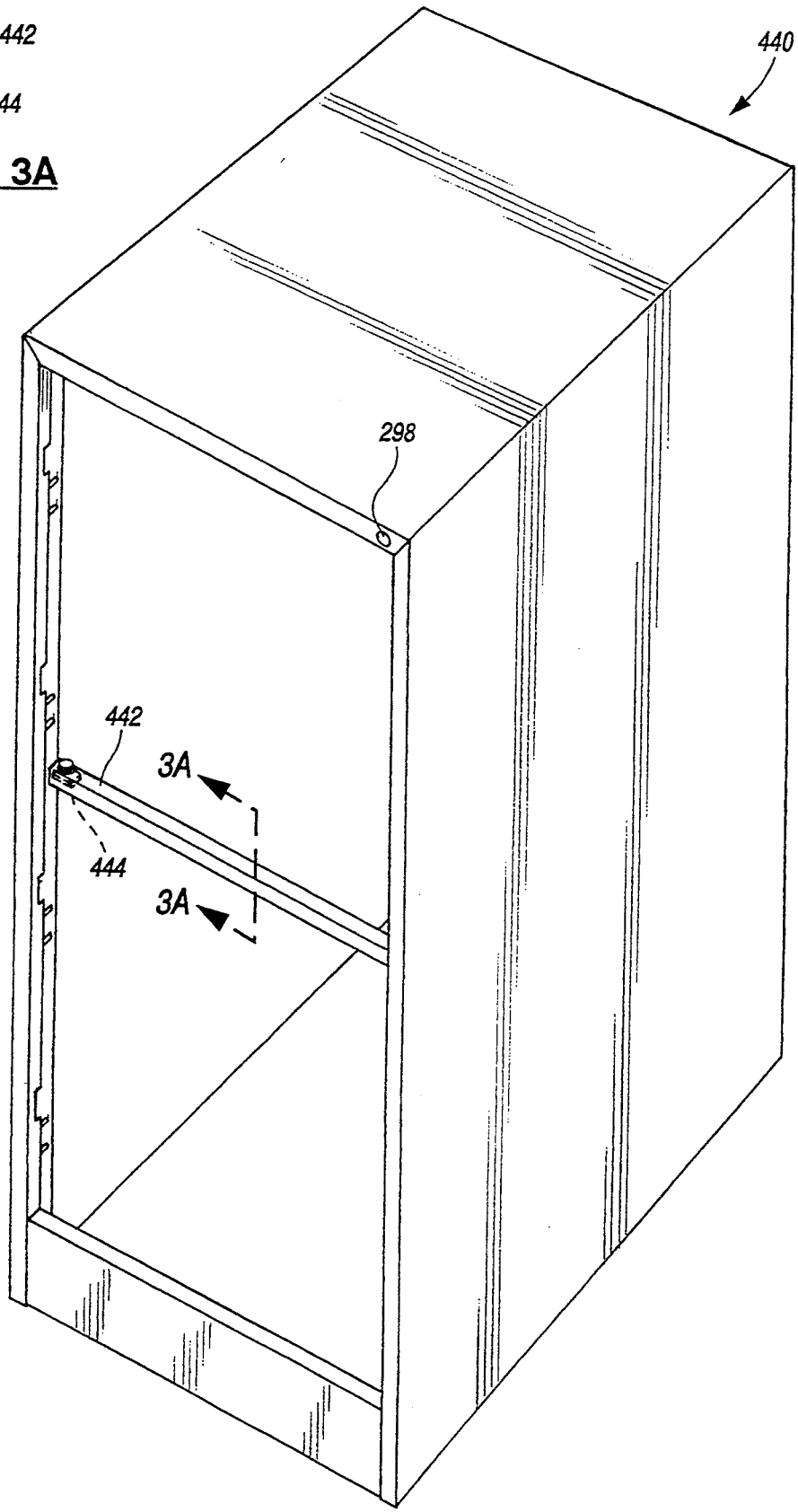
FIG. 3 is a front perspective view of an embodiment of the cabinet of of FIG. 1 for a four drawer filing cabinet with a center divider across the front opening.
Figure 9:
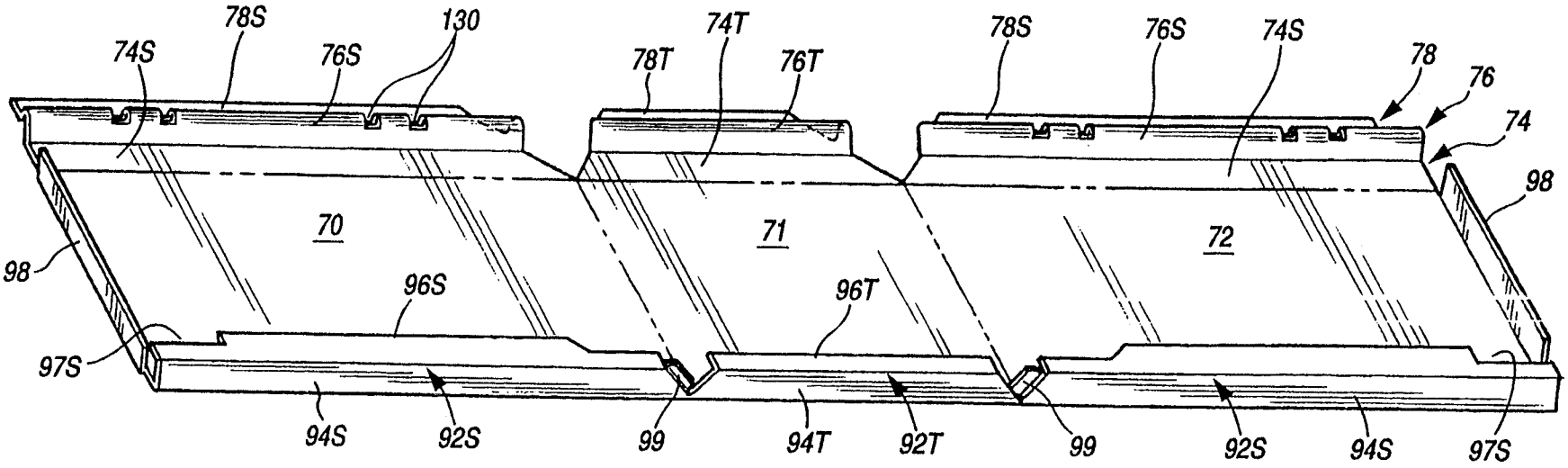
FIG. 9 is a perspective view of a blank prepared for forming the case wrapper of a cabinet as in FIG. 1.
Figure 9A:
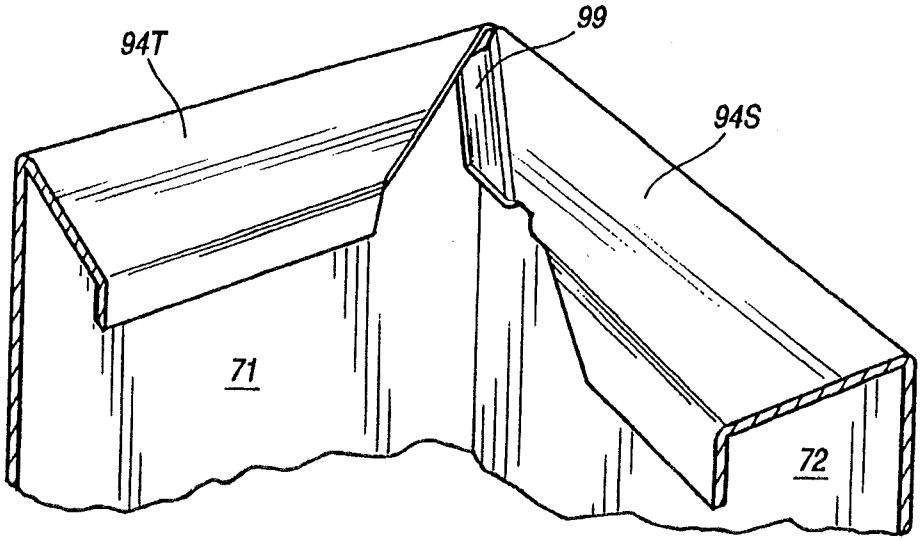
FIG. 9A is an enlarged partial view of the upper right corner of a cabinet case wrapper as the blank of FIG. 9 is being formed into its case wrapper configuration.
Figure 10:
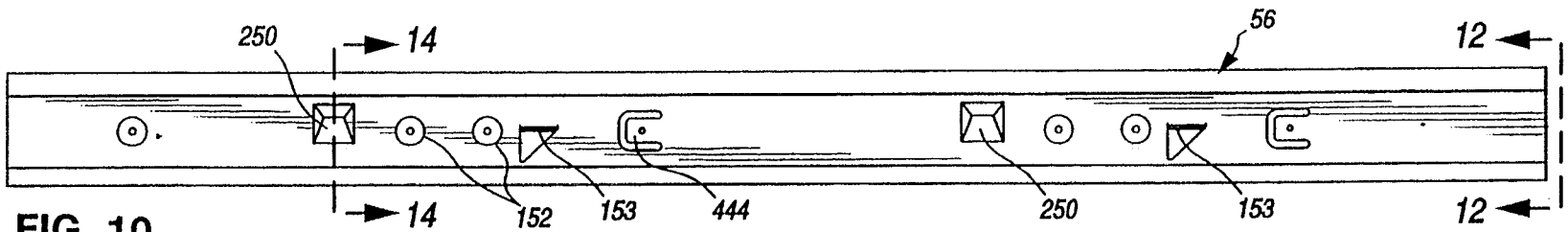
FIG. 10 is a plan view of the left hand vertical channel of FIG. 1.
Figure 11:
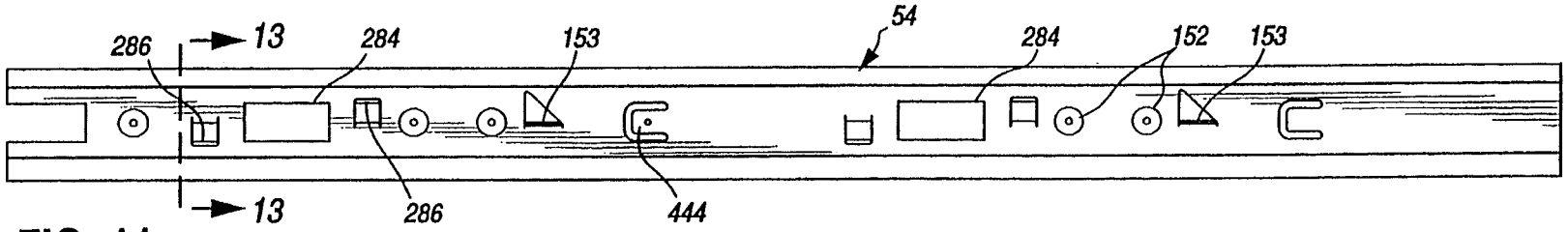
FIG. 11 is a plan view of the right hand vertical channel of FIG. 1.
Figure 14:
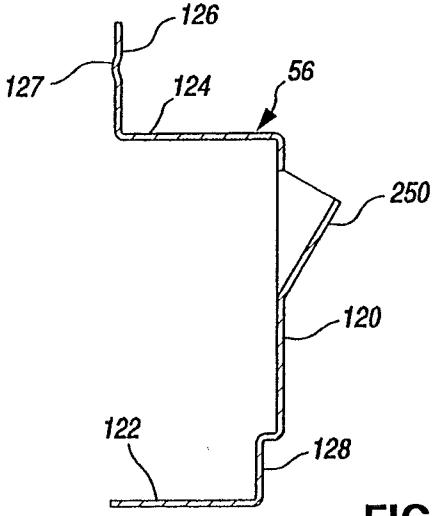
FIGS. 12, 13 and 14 are enlarged views of the channels of FIGS. 10 and 11 taken along lines 12, 13 and 14, respectively.
Figure 19:
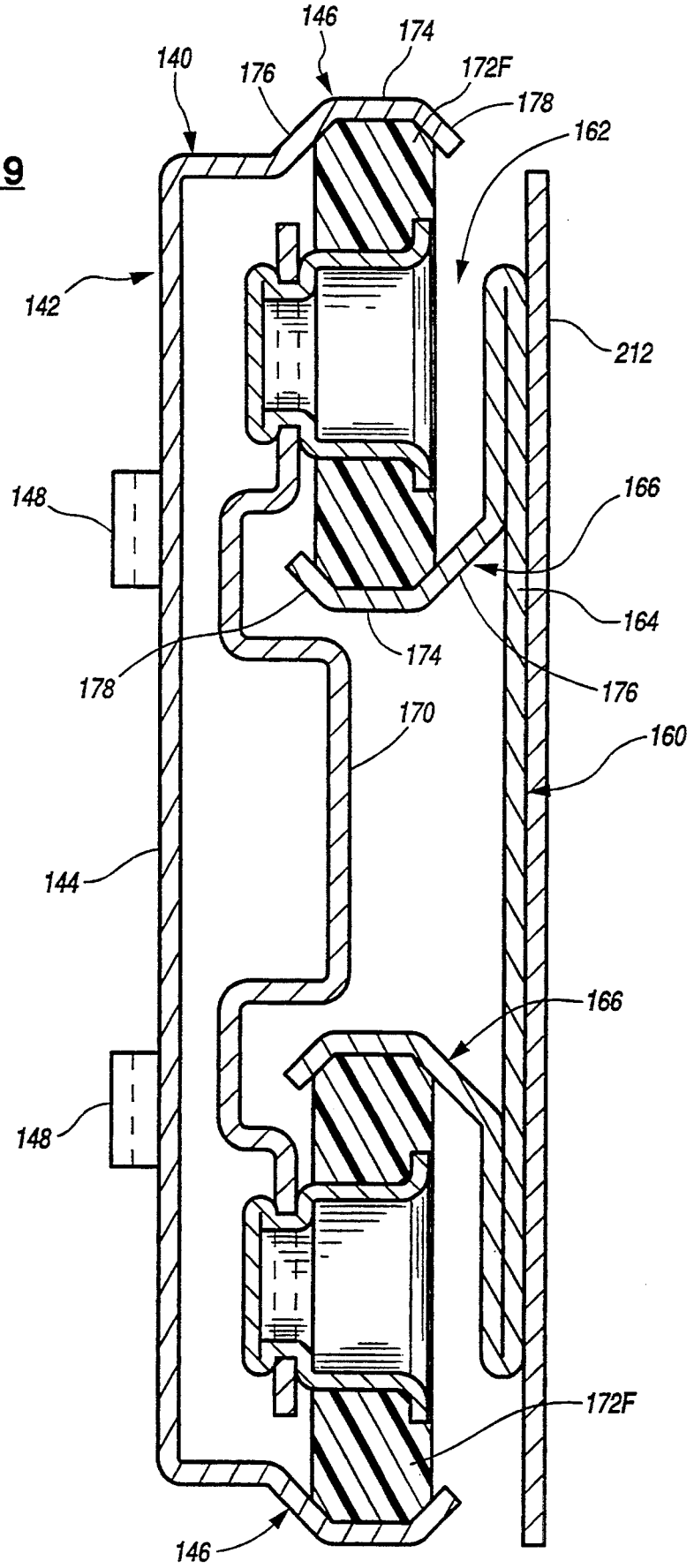
FIG. 19 is a vertical section of a drawer roller slide support assembly employing teachings of this invention, secured to a drawer.
Figure 20:
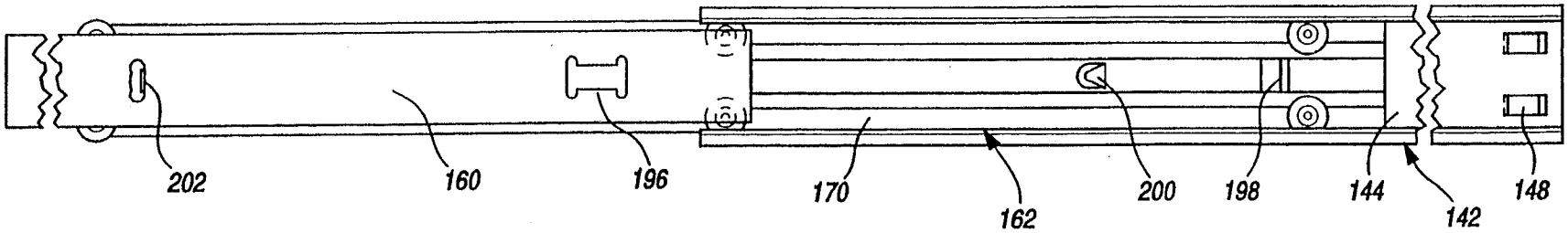
FIG. 20 is a plan view of the roller slide support of FIG. 19 in its fully extended condition.
Figure 21:
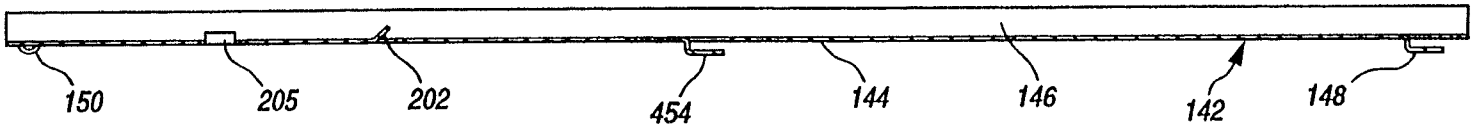
FIG. 21 is a section of the case track member of the assembly of FIG. 19, taken along the irregular line 21—21 of FIG. 5, but reversed end-for-end in the orientation of FIG. 20.
Figure 22:
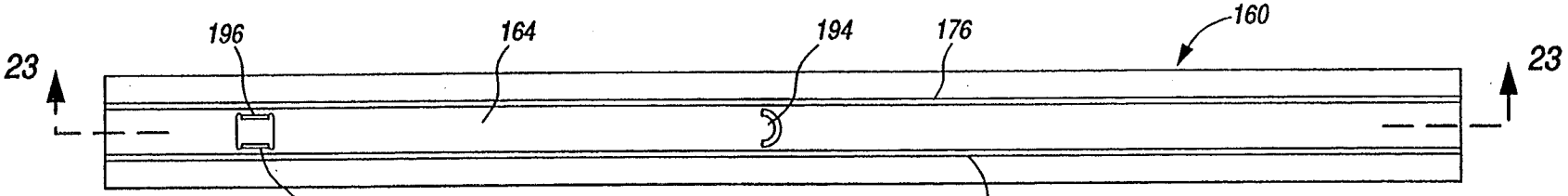
FIG. 22 is a plan view of the drawer track member of the assembly of FIG. 19.
Figure 23:
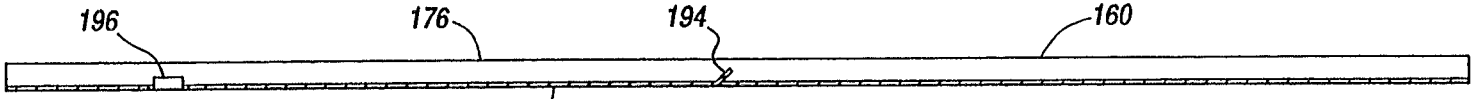
FIG. 23 is a center section view taken along line 23—23 of FIG. 22.

The cabinet 40 is adapted for use as a multiple-drawer filing cabinet by virtue of adaptations included in the two vertical channel supports 54, 56 and the provision of notches 130 in the inward portions of the ribs 76S for mounting opposed pairs 60, 62 of roller slide assemblies 140 as the drawer supports 60, 62; see FIGS. 5, 9 and 19. Case track members 142 of roller slide assemblies 140 as in FIGS. 19–24 are shown mounted in the cabinet 40 for supporting the drawers. The cabinet 40 is suitable for mounting two drawers, as illustrated. However, by making the cabinet taller and duplicating the support adaptations provided for each drawer support, additional drawers may be included in the cabinet. For example, FIG. 3 illustrates a four-drawer cabinet 440, as will be referred to further below.

Each case track element 142 is a single wide, shallow, C-shaped channel which includes a planar web 144 with opposed inwardly facing U-shaped roller guide flanges 146 along its longitudinal edges. Two parallel tabs 148 are struck from the rear portion of the web 144 and bent outwardly to form U-shaped pockets with the web 144 for engaging a rib 76S at an appropriate pair of the notches 130, as in FIG. 5. The bights of tabs 148 rest on the lower surfaces of those notches to support the inner ends of the case track members 142. A pair of conical locating and mounting dimples 150 are formed in the forward end of each case track member 142 for complementary mating engagement with a pair of locating dimples 152 provided in appropriate locations in the web 120 of each vertical channel 54, 56. By engaging the tabs 148 in the notches 130, and then locating and securing the front end of each member 142 as by applying a metal screw 156 through the center openings in the dimples 150, 152 (see FIG. 6F) each of the case track members 142 is properly located and secured in the cabinet case. Triangular support tabs 153 also are provided on each channel 54, 56 to receive thereon and further support the forward end of each case track member 142. In the illustrated embodiment these tabs 153 are struck and formed from the channel webs 120.

Opposed pairs of the case track members 142 are mounted, in numbers appropriate to the number of drawers to be mounted in the cabinet and the intelligence provided by the notches 130 and the dimple holes 152 for the particular filing cabinet arrangement desired.

Referring further to FIGS. 19–25, each of the roller track assemblies also includes a drawer track member 160 and an intermediate roller assembly 162. Each drawer track member 160 is illustrated as an integral component which includes an elongate web 164, to be secured to the side of a drawer sidewall 212 and oppositely disposed, outwardly facing J-shaped return portions 166 along its two longitudinal edges. The intermediate assembly 162 includes a center carrier plate 170 on which three pairs of opposed rollers 172F, 172C and 172R are rotatably mounted.

The track portions 146 and 166 of the roller slide assembly 140 are disposed in aligned opposed pairs. Each is of a shallow channel configuration whereby each defines a center horizontal trackway portion 174, a proximal inclined lateral guide portion 176 and a distal inclined lateral guide portion 178. The track and roller components are of dimensions such that each roller 172 is laterally confined by the flanges 176, 178 of an opposed pair of the track sections 146, 166. This provides lateral positioning control of the intermediate assembly 162 and of the drawer track member 160, and thus of each drawer which is carried by the drawer track assemblies 140.

Figure 24:
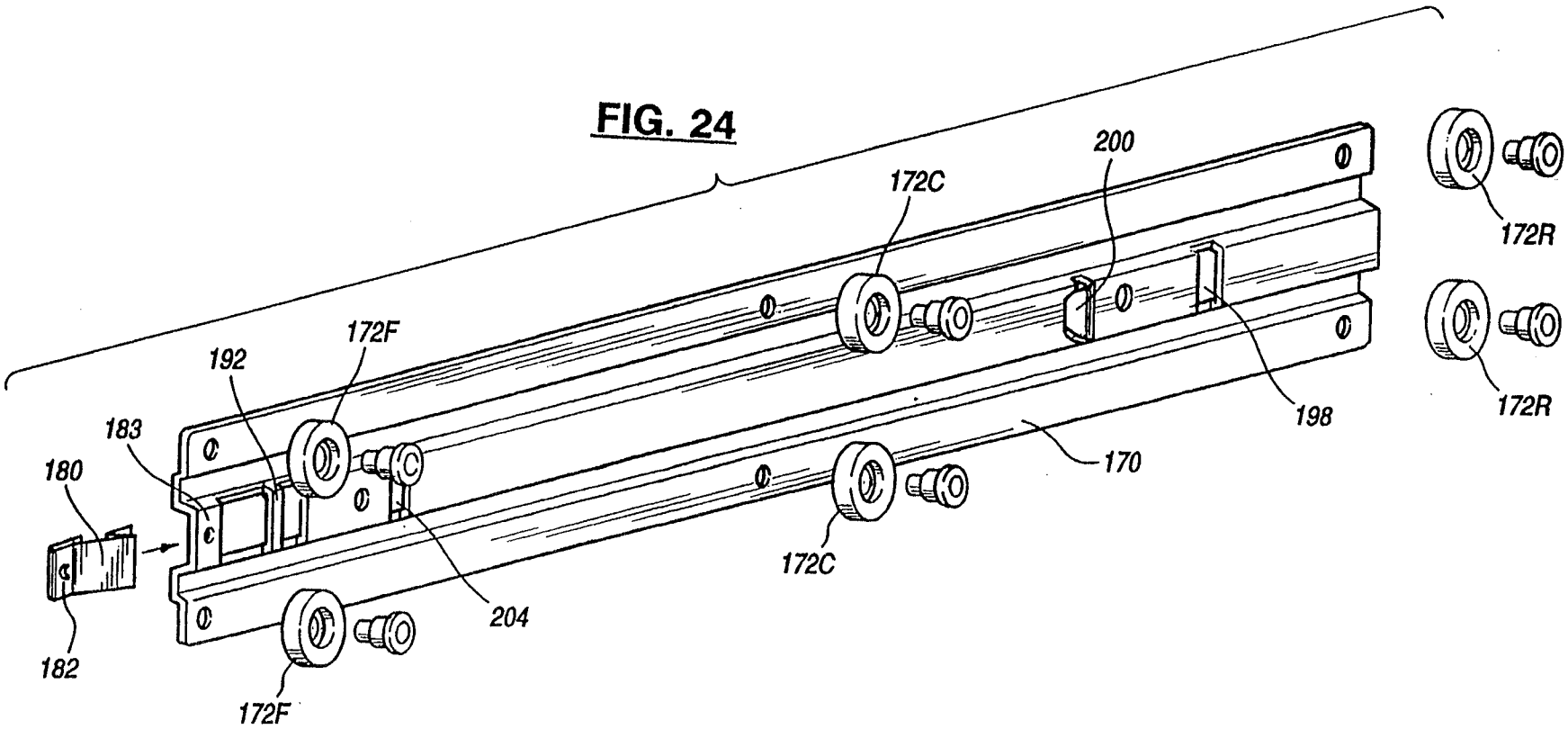
FIG. 24 is an exploded perspective view of the roller track member of the assembly of FIG. 19.
Figure 24A:
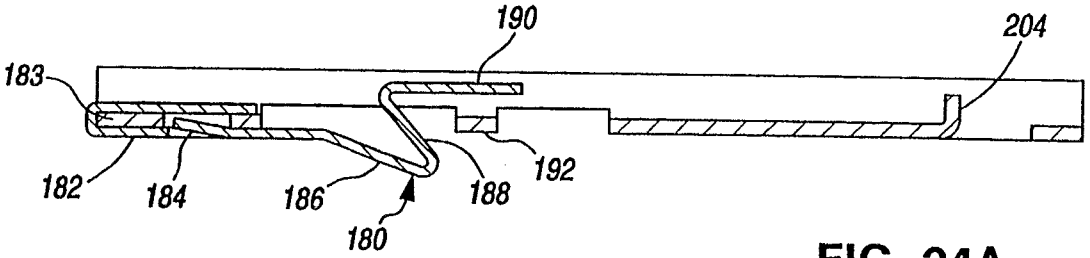
FIG. 24A is a partial enlarged section view taken along the centerline of the clip and track member of FIG. 24.

The drawer support members 142, 160, 170 include appropriate stop elements to limit the relative movement therebetween when the assembly is extended as when opening a drawer. One stop set includes releasable catches to permit deliberate disengagement of the stop mechanism for removing a drawer and its attached pair of drawer track members 160. In these regards, referring to FIGS. 24 and 24A, a Z-shaped flat steel spring latch member 180 has a C-shaped base end 182 which fits closely over a cross-bar 183 of the intermediate track frame and is secured thereto by a cam tab 184 which snaps into an opening 185 in the cross-bar. A body portion 186 is inclined forwardly and outwardly from the base 182 to a latch section 188 on the outer side which is inclined rearwardly and extends through the body of the support 170. A distal end section 190 extends behind a second transverse bar portion 192 for support. When the slide support is fully extended, as when a drawer is fully extended from the cabinet, the ramp undersurface 188 engages a tab 194 which is struck from and extends outward and forward at about 45 degrees on the drawer track 160, see FIGS. 22 and 23. This provides a limit stop. The spring finger 180 also may be selectively retracted inwardly by a user to allow intentional passage of the tab 194, such as when the drawer and attached tracks 160 are to be intentionally removed from the cabinet.

Another tab 200 struck inwardly at approximately 45 degrees from the plane of the intermediate support 170 engages a similar tab 202 struck outwardly from the body of the case track 142 as a limit stop for relative extension movement between those two support components. The noted angular relationship of the engageable stop tabs and latches provide a relatively soft engagement action at the limits of extension, despite the metal to metal contact, and assures positive engagement between these components.

Parallel right angular tabs 196 at the inner end of the drawer track 160 abut a right angular upstanding tab 198 on the intermediate support 170 for a fixed limit stop between these track elements as they are telescopically collapsed relative to one another when the drawer is being closed. Similarly, a tab 204 projects outward from the intermediate track frame to engage a pair of parallel tabs 205 which project inward from the case track body 144 for a fixed limit stop between these track elements as they are telescopically collapsed.

Figure 25:
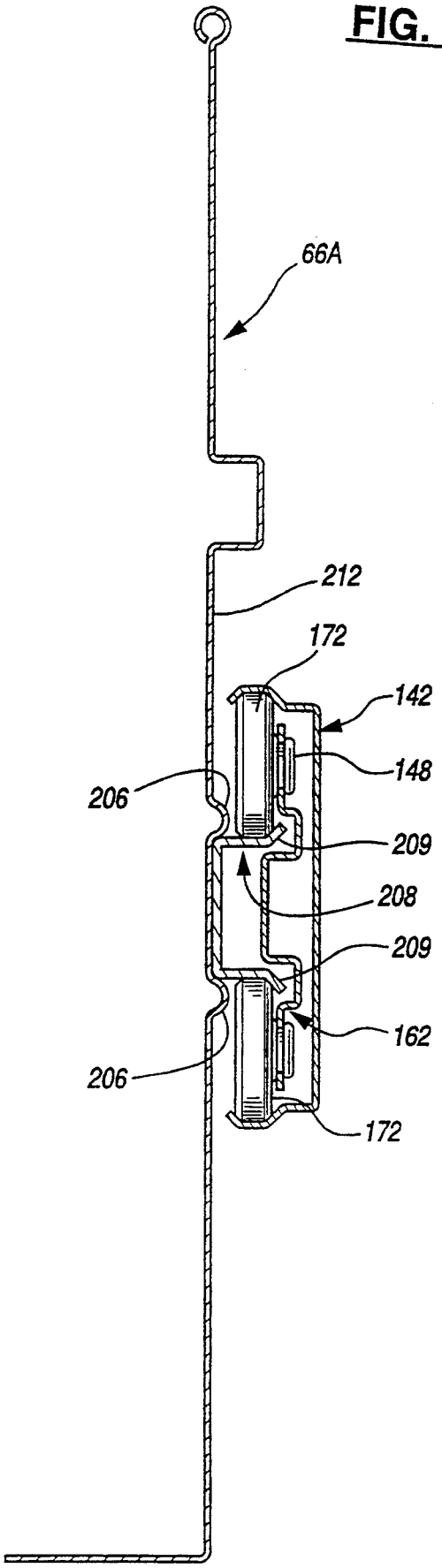
FIG. 25 is a vertical sectional view of the side of a drawer and including another embodiment of a drawer slide assembly employing teachings of this invention.
Figure 26:
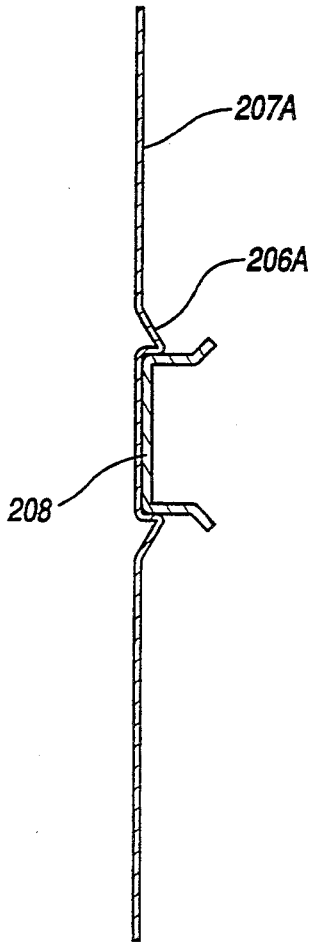
FIG. 26 is a vertical section view of the side of a drawer illustrating an alternative configuration for the drawer track portion of an assembly as in FIG. 25.
Figure 27:
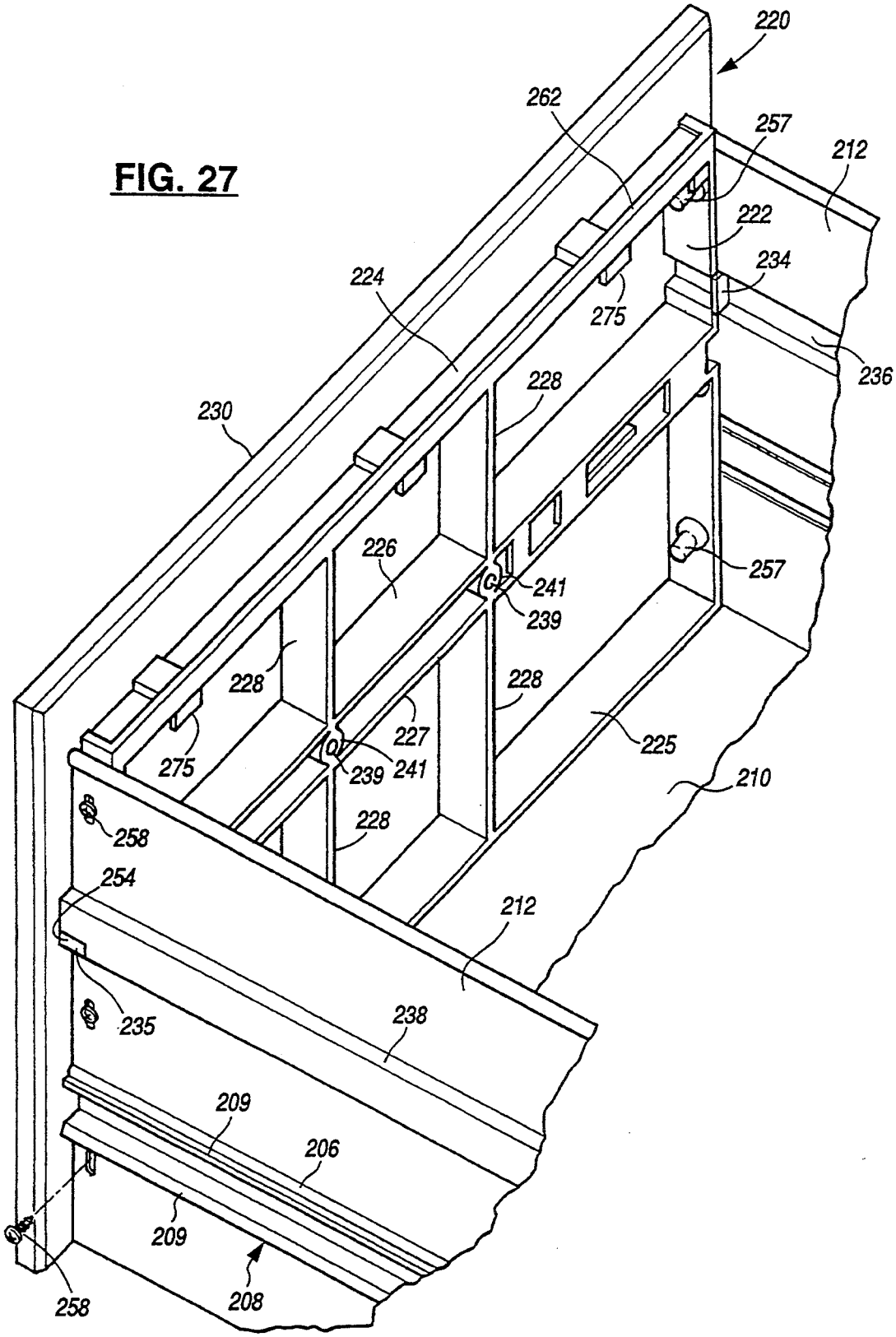
FIG. 27 is a rear perspective view of a file drawer employing teachings of this invention, including a molded plastic subfront with the inner cover panel removed, and shown with an integral drawer track as in FIG. 25.
Figure 28:
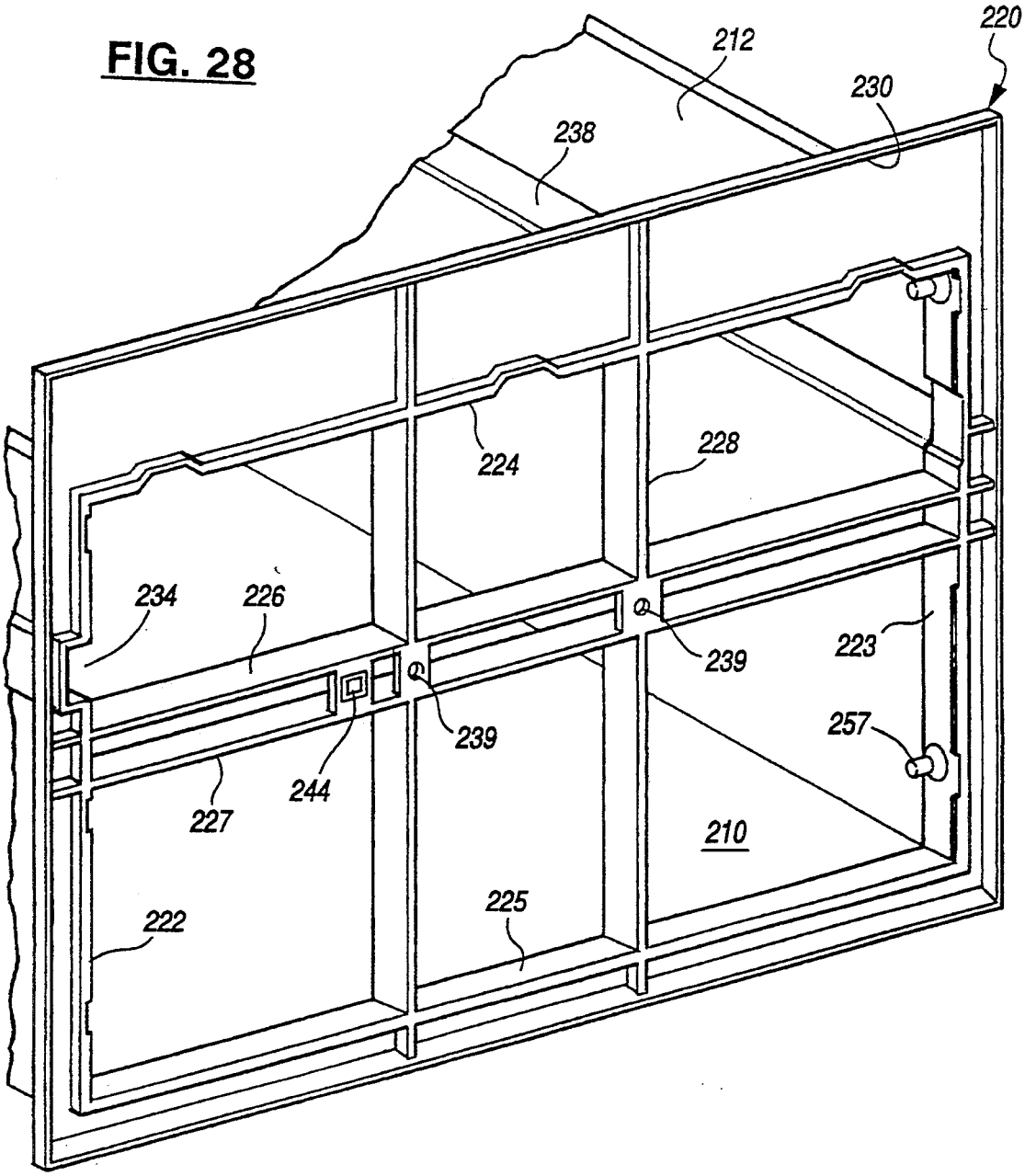
FIGS. 28 and 29 are front perspective views of a file drawer as in FIG. 27, with the front cover plate removed in FIG. 28 and with conventional drawer sides.

FIG. 25 illustrates a preferred embodiment of the roller track assembly, in which the drawer track is formed as an integrated part of the drawer. A pair of parallel outwardly projecting rounded ribs 206 are formed in the side wall 212 of the drawer 66A and provide the inner lateral guides for the rollers 172. A channel element 208 is affixed to the side wall 212 between the ribs 206. The flanges of the channel 208 and their outer distal edge portions 209 provide the horizontal tracks for the rollers 172 and form the outer lateral guides, respectively, to confine and guide the rollers in the manner described above for the drawer track 160. FIG. 27 illustrates an alternative configuration of the guide ribs 206A in a drawer side wall 207A.

Referring now to FIGS. 27–31, each of the drawers 66 preferably comprises a drawer body formed of sheet metal, which includes a bottom 210, opposite side walls 212 and a rear wall 214 (see FIG. 1). The drawer as illustrated in FIG. 27 includes integrally formed drawer tracks of a roller slide assembly as in FIG. 25. The other figures illustrate more conventional drawer bodies to which would be attached drawer tracks as in FIG. 19. In each instance, a unitary subframe 220 of molded plastic provides the structural front member of the drawer. The frame 220 provides the structural strength of the front of the drawer and includes configurations ("intelligence") for mounting of a latch mechanism at one side and for a lock mechanism at the other side of the respective file case.

Figure 29:
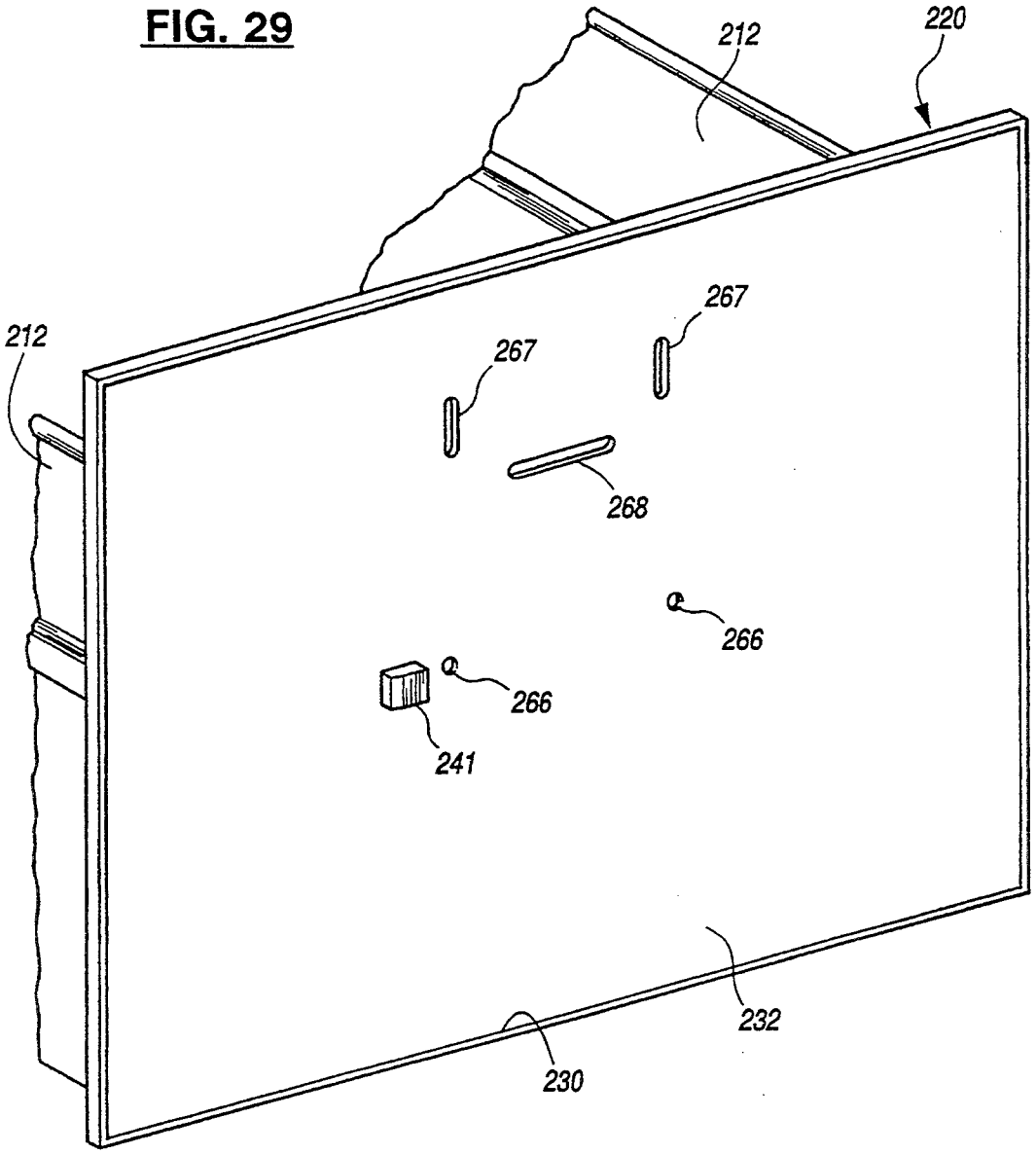

The subframe 220 is in the nature of a molded plastic grill configuration, with vertical side ribs 222, 223, horizontal top and bottom ribs 224 and 225, a pair of parallel horizontal ribs 226 and 227 in the central area, and vertical ribs 228 joining the top and bottom rib structure with the ribs 226, 227. The front edges of the rib matrix define a plane surrounded by a forwardly protruding edge lip 230 which extends around the entire periphery of the front structure 220. A flat decorative finishing panel 232, preferably of prefinished metal corresponding to the material and color of the respective cabinet 40, fits within the lip 230 and is adhesively secured to provide a finished front surface as generally illustrated in FIG. 29. The lip 230 covers and thus "hides" the edges of the front finished plate 232. This preserves a finished appearance even when plates 232 have a raw edge such as may result from being stamped or otherwise cut from prepainted sheet metal stock. Drawers of generic construction can be adapted to any color and finish of the cabinet unit in which to be used simply by selecting and applying plates 232 of the appropriate material and finish.

The molded subfront 220 includes the respective flanges and ribs 222–228 and bosses projecting outwardly therefrom, as at 234 and 235 (FIGS. 30 and 31), for mating engagement in opposed channels 236 and 238 formed in the drawer side walls 212. The parallel center ribs 226, 227 may be joined by vertical plate sections and bosses 241 with holes 239 for receiving screws 240 such as for mounting a drawer pull 241. The center horizontal ribs also define a channel therebetween in which a latch bar (not shown) may be guided for reciprocable sliding movement laterally of the drawer. The outer end of the latch bar extends outward through an opening 242 in the rib 222 and the left wall of the drawer to engage an appropriate latching surface on the file case. In the illustrated embodiment such latch surfaces are provided by ramp tabs 250 struck and formed from the left side vertical channel 56; see FIGS. 10 and 14. An aluminum latch-operating thumb button 243 is provided with a thin mounting blade 243A which is inserted through an appropriate rectangular opening (not shown) in the drawer front plate 232 and opening 244 in the frame 220, with the button 243 on the front side as illustrated. These openings are of a length to accommodate the lateral movement of the mounting blade as the latch bar is moved back and forth between the latching and unlatched positions. An appropriate spring (not shown) also is mounted in the subframe to bias the latch to the latching position.

At the opposite side of the drawer (the right side in FIG. 28 of the drawings), the subfront includes a molded locking boss 235, which projects through an opening 254 in the outer wall of the respective drawer channel 238. The boss 235 includes a recess 255 in its underside for selective engagement by locking elements of a locking bar for locking each of the respective drawers in a closed position. Such a locking bar with tabs 256 for engaging the recesses 255 and adjacent edges of openings 254 is illustrated in FIGS. 15–18 and described further hereinbelow. Bosses 257 receive securing screws 258 applied through holes in side walls 212 for securing the subfront 220 in the drawer.

The use of a plastic subfront which surrounds the metal front finish plate ensures the presentation of plastic tapered outer edges which will not damage paint or other finishes on the cabinet during shipment or use. Also, the molded plastic construction readily permits rounded corners to avoid sharp edges and permits making a complex part to provide the fitting, latching and locking mechanism by a simple manufacturing process, while providing strength and rigidity in an economically formed sheet metal drawer. Stop tabs also may be struck and raised from the bottom drawer wall 210 to serve as indexing stops and when assembling the subfront and drawer box.

The subfront 220 may include a molded-in hangrail 262 along its top for engagement by one end of hanging folders. An appropriate follower plate or other support may be provided for supporting the opposite ends of such folders. Openings 266 also are provided in the drawer front for attaching a drawer pull, as noted above, with additional openings 267 for mounting a label holder (not shown). A forwardly protruding elongate embossment 268 serves as a shelf or stop to prevent thin labels from sliding downward out of the holder.

An inner cover plate 270 covers the inner surface of the molded subfront 220 in an assembled drawer. The plate 270 includes a main panel 272 formed with two transverse ribs 273 for rigidity and a bottom flange 274. The plate 270 is mounted by inserting its upper edge behind downwardly extending tabs 275 included at the top edge of the subfront 220, and inserting its flange 274 in a slot 276 formed by bottom rib 225 and a lower rib 278. The screws 240 extend through holes in the plate 270 and through the subfront and front plate 232, into the pull handle 241 as noted above, to also secure the plate 270 in place.

Figure 13:
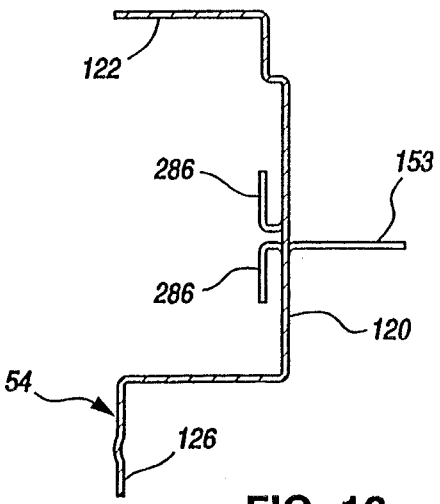
Figure 12:
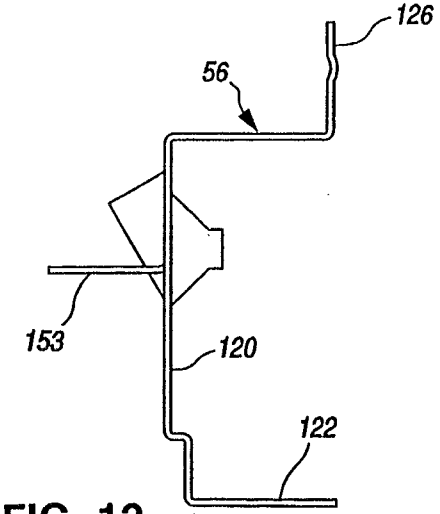
Figure 15:
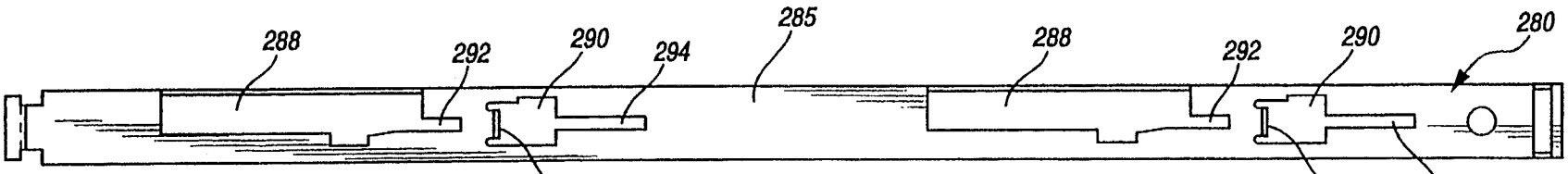
FIGS. 15, 16 and 17 are plan, side and end views, respectively, of the lock bar included in the assemblies of FIGS. 5 and 6F.
Figure 16:
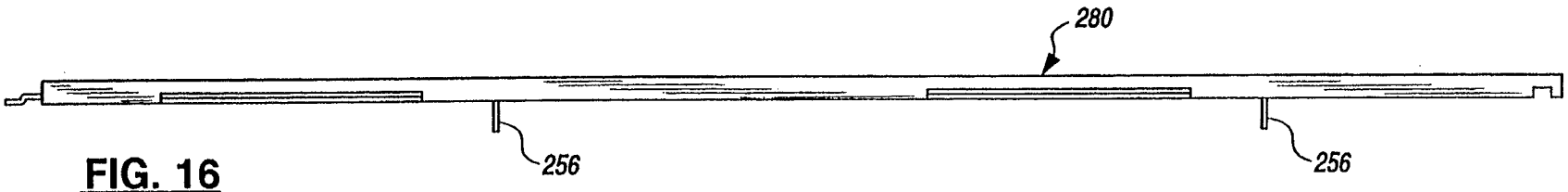
Figure 18:
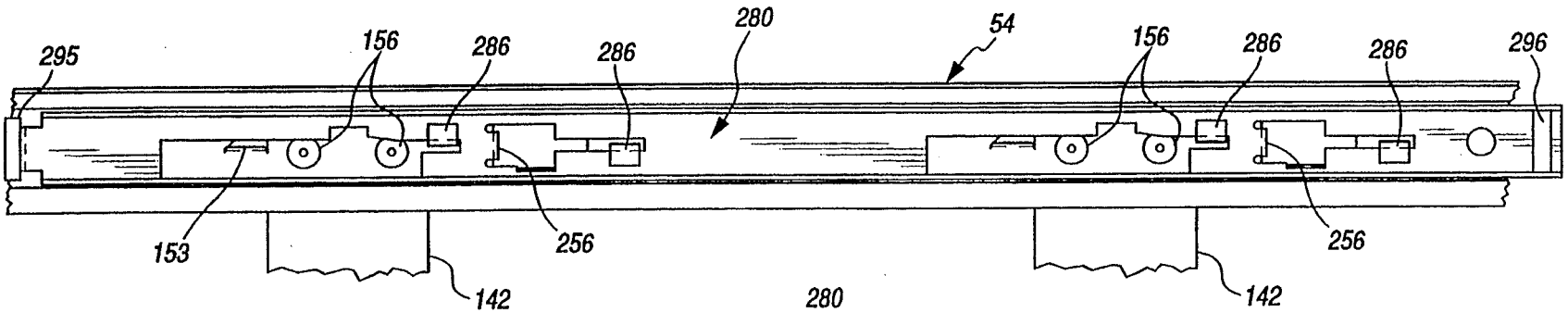
FIG. 18 is a partial rear view of the assembled right channel, lock bar, including parts of two drawer slide supports.
Figure 17:
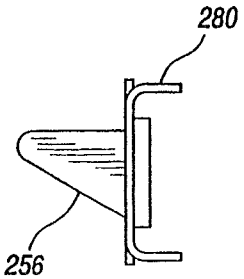

Referring to FIGS. 15–18, a locking bar 280 is slidably attached to the inner surface of web 120 of the right-hand vertical channel 54. The bar is of shallow channel cross-section, as seen in FIG. 17, and carries latch tabs 256 which project outward through elongated openings 284 in the channel 54 (see FIG. 11). In the illustrated embodiment, the latch tabs 256 are struck from and bent at right angles to the web 285 of the bar 280 to project through the openings 284. Sets of opposed L-shaped tabs 286 are struck from the web 120 of channel 54 and protrude on the inner surface as illustrated in FIG. 13. The lock bar 280 is formed with enlarged openings 288 and 290 and narrow slots 292, 294 which communicate therewith. The openings 288 are of sufficient size to accommodate the inner ends of the mounting dimples 152 and mounting screws 156. The enlarged openings permit mounting of the bar 280 against the inner surface of the web 120 by passing the tabs 286 through the openings 288, 290. Thereafter the bar is moved longitudinally to engage the tabs in the slots 292,294, as seen in FIG. 18 with, with a close fit of the bar under the tabs. Thereby, the bar 280 is firmly mounted against web 120 in a simple fashion for relative reciprocal movement longitudinally of the channel 54 between drawer-locked and drawer-unlocked positions, without application of separate fasteners. The manner of mounting and retaining of the bar 280 against the surface of the support channel 56 provides secure support against the lateral and torsional forces of attempts to forcibly open locked drawers, and minimizes or eliminates rattling of the bar 280 in the assembly. The shallow bar 280 also is held clear of any adhesive that may extrude from the lamination joints of the overlying member 56. Reciprocal movement of the bar 280 is obtained by a conventional drawer lock mechanism such as those known in the art. An opening 298 is illustrated for such a mechanism.

The bar 280 is provided with an offset T-section 295 at one end and a mating slot 296 at its opposite end. Two such 2-drawer bars may be joined by engaging the T-section 295 in the slot 296 of the other to form a 4-drawer lock bar.

It will be appreciated that numerous other embodiments may be made within the scope of this invention. For example, the number and sizes of drawers to be accommodated can be altered by varying the dimensions of the cabinet and/or the mounting elements provided by the vertical side channels. FIG. 3 illustrates a four-drawer cabinet case embodiment 440 of the same construction as cabinet case 40 and which is significantly taller than the cabinet case 40, and in which the mounting, latching and locking elements of the side channels 54,56 are replicated in each channel as appropriate to the size and number of drawers to be mounted and to the slide supports to be used. In addition, a divider channel 442 spans the front opening of the cabinet between the positions of two of the drawers to provide additional stability and positioning control of the front portions of the side panels. The divider channel abuts the two vertical support channels and is attached to tabs 444 which are struck and bent from those channels, as by screws 446; see also FIGS. 3A, 10 and 11. Such bracing divider channels may be provided between any or all adjacent pairs of drawers, as desired.

Figure 5A:
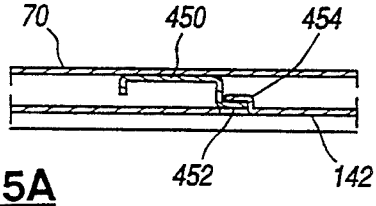
FIG. 5A is a partial sectional view taken along line 5A—5A of FIG. 5.

Bracing and support components also can be varied. For example, FIGS. 5 and 5A illustrate the inclusion of additional vertical support channels 450 to provide additional stability for drawer supports in deep cabinets. A C-shaped channel 450 is positioned vertically in the mid-area of each side panel of the cabinet, between the case track members 142 and the respective side panel of the cabinet and with the web of each channel adhesively laminated to the adjacent inside surface of the respective side panel. Each channel 450 includes a lateral flange 452 extending forward, toward the front of the cabinet, adjacent the inner front edge of the channel. Vertically spaced L-shaped tabs 454, which are struck and bent from the web of each of the case track members, engage the flange 452 to provide added lateral and torsional stability of the case track members. The flange 452 preferably is of double thickness by reverse bending the edge portion of the channel over the flange width for added strength and to form a rounded distal edge for ease of engagement of the tabs 454 thereover. Many other changes may be made in the shapes and sizes of the channels and other components. It is preferred to form the components of the cabinet case from prepainted steel stock of indeterminate length and of specific widths correlated to the various components to minimize or eliminate the necessity to cut side edges and for efficient use of the stock materials, as described in the aforenoted prior patent applications. In that regard, by way of example, the case wrapper 42 may be formed from one strip blank having a width equal to the total cumulative lateral dimensions of the wrapper and its front and rear flange portions. The case back 44, base pan/kickplate 46, and top front and rear stiffeners 48 and 50 may be formed from a second strip blank having a width approximately equal to the width of the cabinet. The front and center vertical channels 54, 56 and 450 may be formed from a third strip blank having a width corresponding to a common total lateral dimension of those components. The drawer bottoms 210, subfront back covers 270, and bottom front stiffener 46 may be formed from a fourth strip blank having a width corresponding closely to the lateral dimensions of those components.

It will thus be seen that improved designs and methods have been provided which meet the aforestated objects.

It is contemplated by the appended claims to cover any such modifications and other embodiments as incorporate those features which constitute the essential features of this invention within the true spirit and scope of the following claims.

What is claimed is:

1. A storage cabinet formed of a plurality of sheet metal panels joined to one another and defining a case of said cabinet with said panels having outwardly disposed surfaces forming external surface portions of said cabinet and opposite inward surfaces; at least a first of said panels being a unitary sheet member having an elongated narrow U-shaped reinforcing rib formed therein along one edge portion of said first panel, said U-shaped rib being open at the external surface of said first panel and extending inwardly of said cabinet from said inward surface thereof; and a second of said panels being a unitary sheet member having a generally planar body portion and an edge portion which includes an elongated flange portion adjacent one edge of said second panel, said flange portion extending inwardly of said cabinet from the inward surface of said second panel; said first and second panels being joined to one another with said flange portion of said second panel overlapping said one edge portion of said first panel and with said flange portion extending within the opening of said U-shaped rib, whereby said first and second panels are joined to one another and form a reinforcing rib; and wherein said panels include first and second unitary side panels defining parallel opposite first and second sides of said cabinet, each of said first and second side panels having an elongated narrow U-shaped reinforcing rib formed therein along one edge portion thereof, said ribs being disposed along opposite edges of a third side of said cabinet between first and second sides and open to said third side and extending inwardly of said cabinet therefrom, and a third side panel spanning said third side and having edge flanges extending into said ribs.

2. The invention as in claim 1 and wherein said U-shaped rib and said flange portion extend substantially normal to the body portion of the respective panel.

3. The invention as in claim 1 and wherein said flange portion of said second panel disposed in said U-shaped rib includes the respective distal edge of the metal sheet member forming said second panel.

4. The invention as in claim 1 wherein said cabinet is formed of prepainted sheet material.

5. The invention as in claim 1 wherein said first of said panels is a vertical side panel of said cabinet and said one edge portion and said rib formed therein are vertically disposed, whereby said rib forms a vertical reinforcing structure of said cabinet.

6. The invention as in claim 1 wherein said panels include a top panel extending between and joined to said first and second unitary side panels, said top panel having an elongated narrow U-shaped reinforcing rib formed therein along an edge portion thereof corresponding to said third side and open to said third side, and said third side panel having a top edge flange extending into said rib of said top panel.

7. The invention as in claim 6 and wherein said first, second and top panels are unitary with one another.

8. The invention as in claim 1 wherein each of said first and second side panels includes a generally planar panel portion each having a rear edge, a narrow flange extending from each said rear edge generally normal to the respective panel portion, and the respective reinforcing rib extends from the distal edge of the respective narrow flange in parallel spaced relation to the respective panel, whereby each rib and the respective narrow flange and edge portion of the respective panel form a C-shaped corner structure of said cabinet.

9. The invention as in claim 1 wherein said cabinet is formed of a plurality of panel components interfitting in edge-overlapping joint relation with one another, said panel components being adhesively bonded to one another substantially continuously throughout the length of each such joint.

10. The invention as in claim 9 wherein said components include such an edge-overlapping joint adjacent each vertical corner of said cabinet, and said components being adhesively bonded to one another substantially continuously throughout the entire length of each such vertical joint.

11. A storage cabinet which comprises a unitary sheet metal case wrapper which includes first and second opposed parallel side panels and a top panel each having front and rear edges and joined to one another along side edges of said top panel; said first, second and top panels having generally planar body portions and flange portions extending from the rear edges of the respective planar portions and forming narrow U-shaped ribs along the top edge and two side edges of the rear side of said cabinet; said U-shaped ribs being open to said rear side; and a rear panel having a generally planar body portion spanning said rear side; said rear panel having top and side edges and edge flanges extending from said top and side edges into said open top and side ribs.

12. The invention as in claim 12 wherein each of said first, second and top panels includes a generally planar panel portion each having a rear edge, a narrow flange extending from each said rear edge generally normal to the respective panel portion, and the respective rib extending from the distal edge of the respective narrow flange in parallel spaced relation to the respective panel, whereby each rib and the respective narrow flange and edge portion of the respective panel form a C-shaped corner structure of said cabinet.

13. The invention as in claim 11 wherein each of said first, second and top panels further includes a distal flange extending from the respective rib on the side thereof opposite the respective narrow flange and in a plane generally parallel to the plane defined by said narrow flange, said distal flanges being offset inward of said cabinet relative to said narrow flanges, and said rear panel overlapping and being secured to said distal flanges.

14. The invention as in claim 11 wherein said cabinet is formed of a plurality of panel components interfitting in edge-overlapping joint relation with one another, said panel components being adhesively bonded to one another substantially continuously throughout the length of each such joint.

15. The invention as in claim 14 wherein said components include such an edge-overlapping joint adjacent each corner of said cabinet, and said components being adhesively bonded to one another substantially continuously throughout the entire length of each such joint.

* * * * *